US012013159B2

(12) United States Patent
Tada et al.

(10) Patent No.: US 12,013,159 B2
(45) Date of Patent: Jun. 18, 2024

(54) AIR-CONDITIONING APPARATUS

(71) Applicant: Mitsubishi Electric Corporation, Tokyo (JP)

(72) Inventors: Yoshiyuki Tada, Tokyo (JP); Masakazu Kondo, Tokyo (JP); Masakazu Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 335 days.

(21) Appl. No.: 17/620,163

(22) PCT Filed: Sep. 20, 2019

(86) PCT No.: PCT/JP2019/037054

§ 371 (c)(1),
(2) Date: Dec. 17, 2021

(87) PCT Pub. No.: WO2021/053821

PCT Pub. Date: Mar. 25, 2021

(65) Prior Publication Data

US 2022/0364777 A1 Nov. 17, 2022

(51) Int. Cl.
*F25B 47/02* (2006.01)
*F25B 13/00* (2006.01)
(Continued)

(52) U.S. Cl.
CPC ..... *F25B 47/02* (2013.01); *F25B 13/00* (2013.01); *F25B 41/20* (2021.01); *F25B 49/02* (2013.01); *F25B 2313/0251* (2013.01)

(58) Field of Classification Search
CPC ..... F25B 47/02; F25B 47/022; F25B 47/025; F25B 49/02; F25B 13/00; F25B 41/26;
(Continued)

(56) References Cited

U.S. PATENT DOCUMENTS

2015/0292756 A1* 10/2015 Takenaka ..... F24F 5/001 62/160
2021/0080161 A1 3/2021 Tashiro et al.
(Continued)

FOREIGN PATENT DOCUMENTS

CN 105509257 A 4/2016
CN 105928279 A 9/2016
(Continued)

OTHER PUBLICATIONS

International Search Report dated Nov. 5, 2019, issued in corresponding International Patent Application No. PCT/JP2019/037054 (and English Machine Translation).
(Continued)

*Primary Examiner* — Miguel A Diaz
(74) *Attorney, Agent, or Firm* — Posz Law Group, PLC

(57) ABSTRACT

An air-conditioning apparatus includes a four-way valve, a first three-way valve and a second three-way valve each having a closed port, a compressor, an indoor heat exchanger, an expansion valve, a first outdoor heat exchanger, a second outdoor heat exchanger, a bypass expansion valve, a check valve, a discharge temperature sensor, an indoor pipe temperature sensor, an indoor temperature sensor, a current sensor, and a controller configured to detect switching failure at the four-way valve, the first three-way valve, and the second three-way valve. The controller is configured to detect switching failure at the four-way valve, the first three-way valve, or the second three-way valve by using the temperatures measured by the discharge temperature sensor, the indoor pipe temperature sensor, and the indoor temperature sensor and the current in consideration of an operation status.

9 Claims, 13 Drawing Sheets

(51) Int. Cl.
*F25B 41/20* (2021.01)
*F25B 49/02* (2006.01)

(58) Field of Classification Search
CPC ..... F25B 2313/025; F25B 2313/0251; F25B 2313/0252; F25B 2313/02521; F25B 2313/02522; F25B 2313/02523; F25B 2313/0253; F25B 2313/02531; F25B 2313/02532; F25B 2313/02533; F25B 2313/0314; F25B 2313/0315; F25B 2500/19; F25B 2700/15; F25B 2700/151; F25B 2700/2104; F25B 2700/21152
See application file for complete search history.

(56) References Cited

U.S. PATENT DOCUMENTS

2021/0348789 A1* 11/2021 Fukui ..... F25B 47/022
2022/0252314 A1* 8/2022 Tashiro ..... F25B 47/02

FOREIGN PATENT DOCUMENTS

| | | | |
|---|---|---|---|
| CN | 108954669 | A | 12/2018 |
| JP | 2012-013363 | A | 1/2012 |
| WO | 2019/146139 | A1 | 8/2019 |

OTHER PUBLICATIONS

Office Action dated Feb. 13, 2023 issued in corresponding CN Patent Application No. 201980100369.0 (and English machine translation).

* cited by examiner

AIR-CONDITIONING APPARATUS

CROSS REFERENCE TO RELATED APPLICATION

This application is a U.S. National Stage Application of International Patent Application No. PCT/JP2019/037054, filed on Sep. 20, 2019, the disclosure of which is incorporated herein by reference.

TECHNICAL FIELD

The present disclosure relates to an air-conditioning apparatus capable of performing a heating operation, a defrosting operation, and a heating-defrosting simultaneous operation.

BACKGROUND

A known air-conditioning apparatus is capable of simultaneously performing a heating operation and a defrosting operation (refer to Patent Literature 1, for example). Patent Literature 1 discloses an air-conditioning apparatus including a refrigeration cycle formed by connecting a compressor, a four-way valve, outdoor heat exchangers connected in parallel, pressure reducing devices arranged adjacent to inlets of the outdoor heat exchangers, and an indoor heat exchanger with refrigerant pipes. This refrigeration cycle is capable of performing a heating operation, a reverse-cycle defrosting operation, and a defrosting-heating operation in which a subset of the outdoor heat exchangers operates as a condenser and the other outdoor heat exchangers operate as evaporators.

This air-conditioning apparatus can defrost the outdoor heat exchangers while continuing heating by performing the defrosting-heating operation. In the defrosting-heating operation, the defrosting capacity of the refrigeration cycle is partly used for heating. This makes the time required to complete defrosting longer than that in the reverse-cycle defrosting operation. In the air-conditioning apparatus disclosed in Patent Literature 1, the defrosting-heating operation causes a reduction in average heating capacity per cycle from the completion of defrosting to the completion of the next defrosting, between which the heating operation is performed.

An air-conditioning apparatus has been developed to increase the average heating capacity (refer to Patent Literature 2, for example). Patent Literature 2 discloses an air-conditioning apparatus including a refrigerant circuit, two three-way valves, a check valve, and a bypass expansion valve. The refrigerant circuit includes a compressor, a four-way valve, a first outdoor heat exchanger, a second outdoor heat exchanger, and an indoor heat exchanger. In this air-conditioning apparatus, the two three-way valves are caused to switch between passages during the heating operation so that either one of the first and second outdoor heat exchangers operates as a condenser and the other outdoor heat exchanger operates as an evaporator, thus achieving a heating-defrosting simultaneous operation.

This air-conditioning apparatus performs the heating-defrosting simultaneous operation when the difference between a maximum operating frequency of the compressor and an operating frequency thereof in the heating operation is greater than or equal to a threshold, and performs the defrosting operation when the difference therebetween is less than the threshold. This increases the average heating capacity per cycle from the completion of defrosting to the completion of the next defrosting, between which the heating operation is performed.

PATENT LITERATURE

Patent Literature 1: Japanese Unexamined Patent Application Publication No. 2012-13363

Patent Literature 2: International Publication No. WO 2019/146139

In the air-conditioning apparatus disclosed in Patent Literature 2, for example, switching failure at the four-way valve or the three-way valves caused for some reason forms a closed circuit in which refrigerant does not circulate through the refrigerant circuit. The closed circuit may cause, for example, an abnormally high pressure at the compressor or demagnetization resulting from an increase in temperature of a motor in the compressor, leading to a breakdown of the compressor. Under such conditions, it is difficult to maintain the quality of the compressor. Unfortunately, typical air-conditioning apparatuses cannot detect switching failure at a four-way valve or a three-way valve.

SUMMARY

In response to the above issue, it is an object of the present disclosure to provide an air-conditioning apparatus capable of detecting switching failure at a valve.

An air-conditioning apparatus according to an embodiment of the present disclosure includes a four-way valve having a first port, a second port, a third port, and a fourth port, a first three-way valve and a second three-way valve each having a fifth port, a sixth port, a seventh port, and an eighth port, the eighth port being closed, a compressor having a discharge portion connected to the first port and a suction portion connected to the second port and the sixth ports of the first and second three-way valves and configured to suck refrigerant, compress the refrigerant, and discharge the compressed refrigerant, an indoor heat exchanger connected to the fourth port and configured to exchange heat between the refrigerant and indoor air, an expansion valve connected to the indoor heat exchanger and configured to reduce the pressure of the refrigerant, a first outdoor heat exchanger disposed between the expansion valve and the seventh port of the first three-way valve and configured to exchange heat between the refrigerant and outdoor air, a second outdoor heat exchanger disposed between the expansion valve and the seventh port of the second three-way valve and configured to exchange heat between the refrigerant and the outdoor air, a bypass expansion valve disposed between the discharge portion of the compressor and the fifth ports of the first and second three-way valves, a check valve having a first end connected to the third port and a second end connected between the bypass expansion valve and the fifth ports of the first and second three-way valves and configured to allow the refrigerant to flow in a direction from the first end to the second end and block the refrigerant from flowing in an opposite direction therefrom, a discharge temperature sensor configured to measure a discharge temperature of the refrigerant discharged from the compressor, an indoor pipe temperature sensor configured to measure a pipe temperature of a pipe through which the refrigerant flows in the indoor heat exchanger, an indoor temperature sensor configured to measure an indoor temperature of the indoor air, a current sensor configured to measure a current supplied to the compressor, and a controller configured to detect switching failure at the four-way valve, the first three-way valve, and the second three-way valve. The air-conditioning apparatus is capable of performing a heating operation in which the first and second outdoor heat exchangers operate as evaporators and the indoor heat exchanger operates as a condenser, a defrosting operation and a cooling operation in each of which the first and second outdoor heat exchangers operate as condensers, and a heating-defrosting simultaneous operation in which one of the first and second outdoor heat exchangers operates as an evaporator and the other one of the first and second outdoor heat exchangers and the indoor heat exchanger operate as condensers. The controller is configured to detect switching failure at the four-way valve, the first three-way valve, or the second three-way valve by using the temperatures measured by the discharge temperature sensor, the indoor pipe temperature sensor, and the indoor temperature sensor and the current value measured by the current sensor in consideration of an operation status.

According to the embodiment of the present disclosure, switching failure at any of the valves can be detected by using, for example, the temperatures measured by the discharge temperature sensor, the indoor pipe temperature sensor, and the indoor temperature sensor.

DETAILED DESCRIPTION

Embodiments of the present disclosure will be described with reference to the drawings. The following embodiments should not be construed as limiting the present disclosure, and can be variously modified without departing from the spirit and scope of the present disclosure. Furthermore, the present disclosure includes any and all combinations of components that can be combined in the following embodiments. In addition, note that components designated by the same reference signs in the following figures are the same components or equivalents. This note applies to the entire description herein.

Embodiment 1

An air-conditioning apparatus according to Embodiment 1 will be described. The air-conditioning apparatus according to Embodiment 1 is configured to perform, at least, a heating operation, a cooling operation, a reverse-cycle defrosting operation (hereinafter, simply referred to as a "defrosting operation"), and a heating-defrosting simultaneous operation.

[Configuration of Air-Conditioning Apparatus 100]

Figure 1:
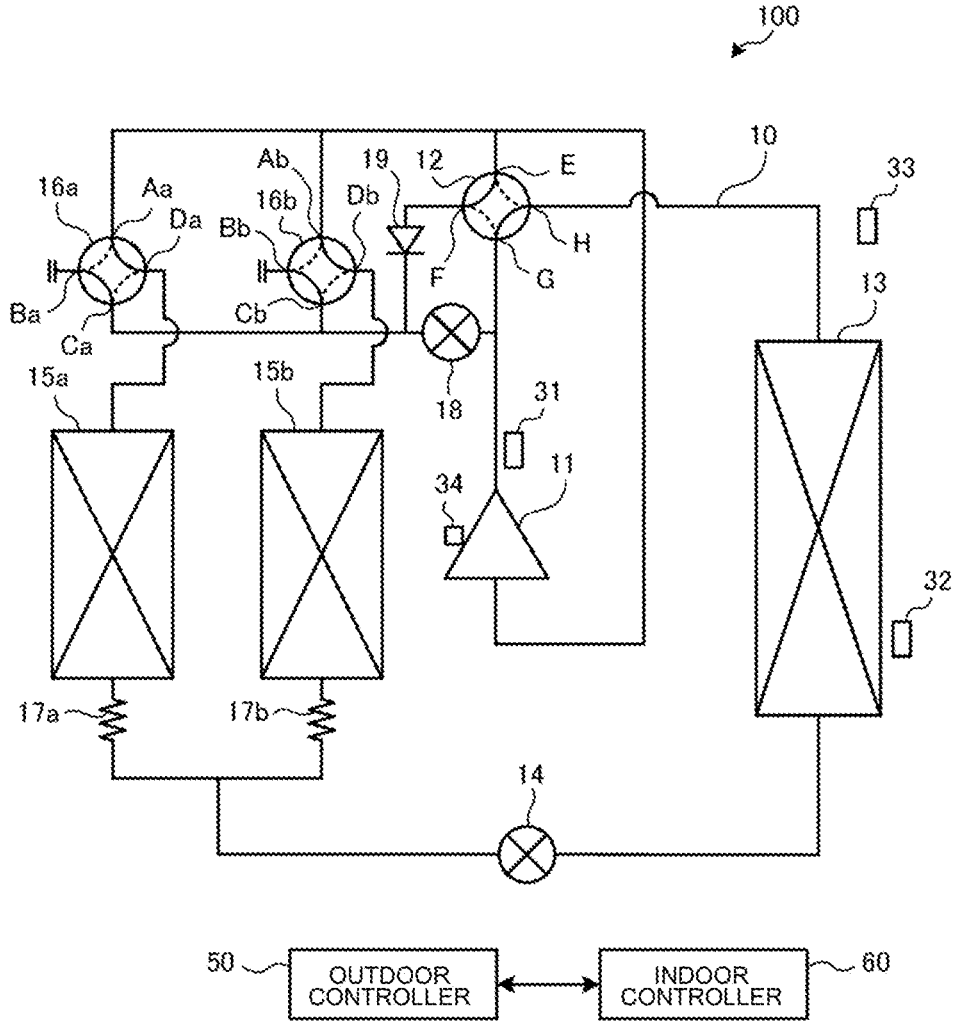
FIG. 1 is a refrigerant circuit diagram illustrating an exemplary configuration of an air-conditioning apparatus according to Embodiment 1.

FIG. 1 is a refrigerant circuit diagram illustrating an exemplary configuration of the air-conditioning apparatus according to Embodiment 1. As illustrated in FIG. 1, the air-conditioning apparatus, 100, according to Embodiment 1 includes a refrigerant circuit 10 through which refrigerant is circulated, an outdoor controller 50, and an indoor controller 60. The controllers control the refrigerant circuit 10. A compressor 11, a four-way valve 12, an indoor heat exchanger 13, an expansion valve 14, a first outdoor heat exchanger 15*a*, a second outdoor heat exchanger 15*b*, a first three-way valve 16*a*, a second three-way valve 16*b*, capillary tubes 17*a* and 17*b*, a bypass expansion valve 18, and a check valve 19 are connected by refrigerant pipes, and the refrigerant flows through these components. Thus, the refrigerant circuit 10 is formed.

The air-conditioning apparatus 100 further includes an outdoor unit installed outside a room and an indoor unit installed inside the room. The outdoor unit houses the compressor 11, the four-way valve 12, the expansion valve 14, the first outdoor heat exchanger 15*a*, the second outdoor heat exchanger 15*b*, the first three-way valve 16*a*, the second three-way valve 16*b*, the capillary tubes 17*a* and 17*b*, the bypass expansion valve 18, and the check valve 19. The indoor unit houses the indoor heat exchanger 13.

(Compressor 11)

The compressor 11 sucks low-pressure gas refrigerant, compresses the refrigerant into high-pressure gas refrigerant, and discharges the refrigerant. As the compressor 11, for example, an inverter-driven compressor whose operating frequency is adjustable is used. The compressor 11 has a preset range of operating frequencies. The compressor 11 is configured to operate at a variable operating frequency included in the range of operating frequencies under the control of the outdoor controller 50.

(Four-Way Valve 12)

The four-way valve 12, which switches between refrigerant flow directions in the refrigerant circuit 10, has four ports E, F, G, and H. In the following description, the port G, the port E, the port F, and the port H may be referred to as "first port G", "second port E", "third port F", and "fourth port H", respectively. The four-way valve 12 can have a first position where the second port E communicates with the third port F and the first port G communicates with the fourth port H and a second position where the second port E communicates with the fourth port H and the third port F communicates with the first port G. Under the control of the outdoor controller 50, the four-way valve 12 is set at the first position in the heating operation and the heating-defrosting simultaneous operation and is set at the second position in the defrosting operation and the cooling operation.

(Indoor Heat Exchanger 13)

The indoor heat exchanger 13 exchanges heat between the refrigerant flowing therethrough and indoor air sent by an indoor fan (not illustrated) housed in the indoor unit. In the heating operation, the indoor heat exchanger 13 operates as a condenser that transfers heat from the refrigerant to the indoor air to condense the refrigerant and heat the indoor air. In the cooling operation, the indoor heat exchanger 13 operates as an evaporator that evaporates the refrigerant to cool the indoor air with the heat of vaporization.

(Expansion Valve 14)

The expansion valve 14 is a valve that reduces the pressure of the refrigerant. As the expansion valve 14, for example, an electronic expansion valve whose opening degree is adjustable under the control of the outdoor controller 50 is used. The opening degree of the expansion valve 14 is controlled by the outdoor controller 50.

(First Outdoor Heat Exchanger 15*a* and Second Outdoor Heat Exchanger 15*b*)

The first outdoor heat exchanger 15*a* and the second outdoor heat exchanger 15*b* each exchange heat between the refrigerant flowing therethrough and outdoor air sent by an outdoor fan (not illustrated) housed in the outdoor unit. The first outdoor heat exchanger 15*a* and the second outdoor heat exchanger 15*b* operate as evaporators in the heating operation and operate as condensers in the cooling operation.

The first outdoor heat exchanger 15*a* and the second outdoor heat exchanger 15*b* are connected in parallel to each other in the refrigerant circuit 10. The first outdoor heat exchanger 15*a* and the second outdoor heat exchanger 15*b* are formed by, for example, dividing a single heat exchanger into an upper portion and a lower portion. In this case, the first outdoor heat exchanger 15*a* and the second outdoor heat exchanger 15*b* are arranged in parallel to each other in a direction in which the air flows.

(First Three-Way Valve 16*a* and Second Three-Way Valve 16*b*)

The first three-way valve 16*a* and the second three-way valve 16*b* each switch between the refrigerant flow directions for the heating operation, for the defrosting operation and the cooling operation, and for the heating-defrosting simultaneous operation. The first three-way valve 16*a* is, for example, a four-way valve having four ports Aa, Ba, Ca, and Da with the port Ba closed to prevent leakage of the refrigerant. In the following description, the port Ca, the port Aa, the port Da, and the port Ba may be referred to as "fifth port Ca", "sixth port Aa", "seventh port Da", and "eighth port Ba", respectively.

The second three-way valve 16*b* is, for example, a four-way valve having four ports Ab, Bb, Cb, and Db with the port Bb closed to prevent the leakage of the refrigerant. In the following description, the port Cb, the port Ab, the port Db, and the port Bb may be referred to as "fifth port Cb", "sixth port Ab", "seventh port Db", and "eighth port Bb", respectively.

The first three-way valve 16*a* and the second three-way valve 16*b* can have a first position, a second position, a third position, and a fourth position. At the first position of the first three-way valve 16*a*, the sixth port Aa communicates with the seventh port Da, and the eighth port Ba communicates with the fifth port Ca. At the first position of the second three-way valve 16*b*, the sixth port Ab communicates with the seventh port Db, and the eighth port Bb communicates with the fifth port Cb. At the second position of the first three-way valve 16*a*, the sixth port Aa communicates with the eighth port Ba, and the fifth port Ca communicates with the seventh port Da. At the second position of the second three-way valve 16*b*, the sixth port Ab communicates with the eighth port Bb, and the fifth port Cb communicates with the seventh port Db.

At the third position of the first three-way valve 16*a*, the sixth port Aa communicates with the eighth port Ba, and the fifth port Ca communicates with the seventh port Da. At the third position of the second three-way valve 16*b*, the sixth port Ab communicates with the seventh port Db, and the eighth port Bb communicates with the fifth port Cb. At the fourth position of the first three-way valve 16*a*, the sixth port Aa communicates with the seventh port Da, and the eighth port Ba communicates with the fifth port Ca. At the fourth position of the second three-way valve 16*b*, the sixth port Ab communicates with the eighth port Bb, and the fifth port Cb communicates with the seventh port Db.

Under the control of the outdoor controller 50, the first three-way valve 16*a* and the second three-way valve 16*b* are set at the first position in the heating operation and are set at the second position in the defrosting operation and the cooling operation. Under the control of the outdoor controller 50, the first three-way valve 16*a* and the second three-way valve 16*b* are set at the third or fourth position in the heating-defrosting simultaneous operation.

(Capillary Tubes 17*a* and 17*b*)

The capillary tubes 17*a* and 17*b* reduce the pressure of the refrigerant. The capillary tube 17*a* is disposed between the first outdoor heat exchanger 15*a* and the expansion valve 14. The capillary tube 17*b* is disposed between the second outdoor heat exchanger 15*b* and the expansion valve 14.

(Bypass Expansion Valve 18)

The bypass expansion valve 18 is disposed between a discharge portion of the compressor 11 and the two three-way valves, or the first three-way valve 16*a* and the second three-way valve 16*b*. The bypass expansion valve 18 adjusts the flow rate of the refrigerant while either one of the first outdoor heat exchanger 15*a* and the second outdoor heat exchanger 15*b* is being defrosted in the heating-defrosting simultaneous operation. The bypass expansion valve 18 is opened or closed under the control of the outdoor controller 50. As the bypass expansion valve 18, for example, an electronic expansion valve is used. The bypass expansion valve 18 may be any other valve, such as a solenoid valve or a motor-operated valve. The bypass expansion valve 18 further has a function of reducing the pressure of refrigerant.

(Check Valve 19)

The check valve 19 is disposed between a downstream side of the bypass expansion valve 18 and the port F of the four-way valve 12. The check valve 19 controls the flow of the refrigerant so that high-pressure gas refrigerant discharged from the compressor 11 does not return to the compressor 11 via the four-way valve 12 in the heating operation or the heating-defrosting simultaneous operation. Specifically, the check valve 19 is configured to permit the flow of the refrigerant in a direction from the port F of the four-way valve 12 to the first three-way valve 16*a* and the second three-way valve 16*b* and block the flow of the refrigerant in a direction from the downstream side of the bypass expansion valve 18 to the port F of the four-way valve 12.

(Sensors)

The air-conditioning apparatus 100 further includes a discharge temperature sensor 31, an indoor pipe temperature sensor 32, an indoor temperature sensor 33, and a current sensor 34. The discharge temperature sensor 31 is disposed at the refrigerant pipe between the compressor 11 and the four-way valve 12 or the surface of the discharge portion of the compressor 11. The discharge temperature sensor 31 measures the temperature of high-temperature gas refrigerant discharged from the compressor 11. The indoor pipe temperature sensor 32 is disposed at the refrigerant pipe in the indoor heat exchanger 13. The indoor pipe temperature sensor 32 measures a pipe temperature, or the temperature of the pipe through which the refrigerant flows, in the indoor heat exchanger 13. In the following description, the pipe temperature in the indoor heat exchanger 13 may be referred to as an "indoor pipe temperature".

The indoor temperature sensor 33 is disposed inside the indoor unit. The indoor temperature sensor 33 measures the temperature of the indoor air. The current sensor 34 is disposed at the compressor 11. The current sensor 34 measures a current supplied to the compressor 11 in operation.

(Indoor Controller 60)

The indoor controller 60 receives information on the temperatures, measured by the indoor pipe temperature sensor 32 and the indoor temperature sensor 33, from these sensors. Furthermore, the indoor controller 60 receives various pieces of information, such as operation information and setting information input by user operations on, for example, a remote control (not illustrated). The indoor controller 60 transmits the received various pieces of information to the outdoor controller 50. The indoor controller 60 is configured as, for example, an arithmetic unit, such as a microcomputer that runs software to implement a variety of functions, or hardware, such as circuit devices corresponding to the functions.

(Outdoor Controller 50)

The outdoor controller 50 receives the various pieces of information, such as the information on the temperatures, from the indoor controller 60. Furthermore, the outdoor controller 50 receives information on the temperature measured by the discharge temperature sensor 31. In addition, the outdoor controller 50 receives information on the current to the compressor 11 measured by the current sensor 34. The outdoor controller 50 controls, based on the received various pieces of information, the components in the refrigerant circuit 10 including the compressor 11, the four-way valve 12, the expansion valve 14, the first three-way valve 16*a*, the second three-way valve 16*b*, the bypass expansion valve 18, and the indoor and outdoor fans (not illustrated).

Figure 2:
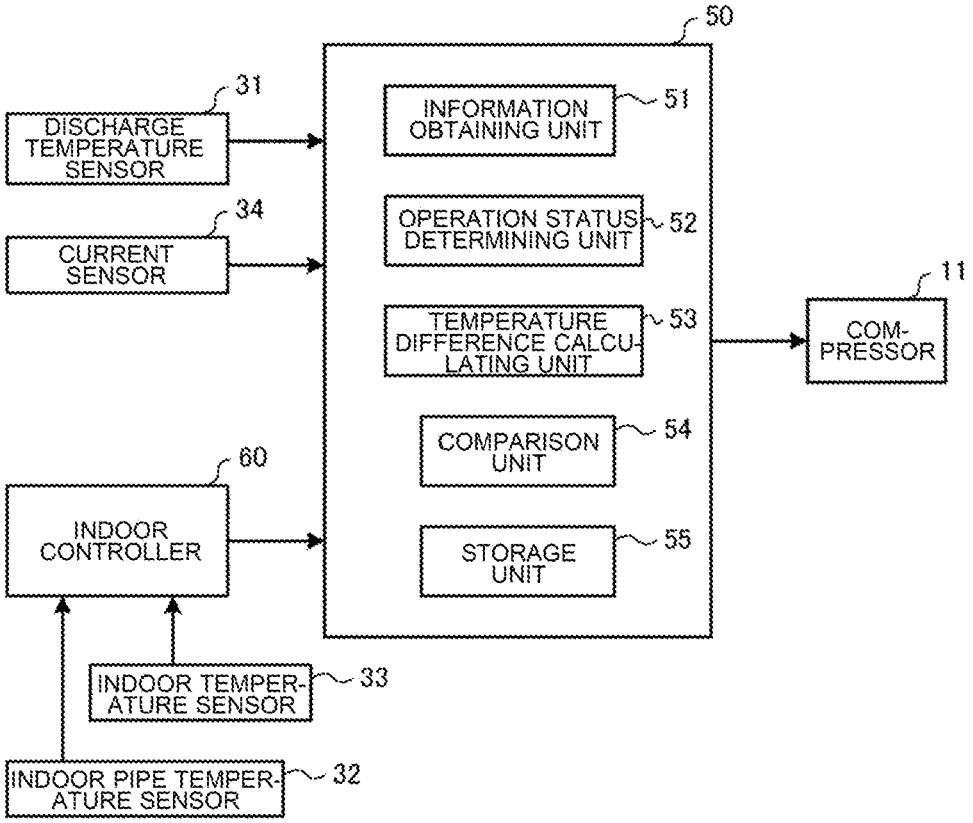
FIG. 2 is a functional block diagram illustrating an exemplary configuration of an outdoor controller in FIG. 1.

FIG. 2 is a functional block diagram illustrating an exemplary configuration of the outdoor controller in FIG. 1. As illustrated in FIG. 2, the outdoor controller 50 includes an information obtaining unit 51, an operation status determining unit 52, a temperature difference calculating unit 53, a comparison unit 54, and a storage unit 55. The outdoor controller 50 is configured as, for example, an arithmetic unit, such as a microcomputer that runs software to implement a variety of functions, or hardware, such as circuit devices corresponding to the functions. In FIG. 2, the components for the functions related to Embodiment 1 are illustrated, and the depiction of the other components is omitted.

The information obtaining unit 51 obtains various pieces of information, such as information on measurements of the sensors in the air-conditioning apparatus 100 and operation information input by a user operation. In Embodiment 1, the information obtaining unit 51 obtains a discharge temperature, or the temperature of the refrigerant discharged from the compressor 11, from the discharge temperature sensor 31. The information obtaining unit 51 obtains an indoor pipe temperature, measured by the indoor pipe temperature sensor 32, via the indoor controller 60. The information obtaining unit 51 obtains an indoor temperature, measured by the indoor temperature sensor 33, via the indoor controller 60. The information obtaining unit 51 obtains a current value I, supplied to the compressor 11, from the current sensor 34. Furthermore, the information obtaining unit 51 obtains operation information on the air-conditioning apparatus 100 set by, for example, a user with the remote control (not illustrated), via the indoor controller 60.

The operation status determining unit 52 determines, based on the operation information obtained by the information obtaining unit 51, an operation status of the air-conditioning apparatus 100.

The temperature difference calculating unit 53 calculates a temperature difference, which is the difference between two pieces of temperature information, on the basis of the indoor temperature, the indoor pipe temperature, and the discharge temperature obtained by the information obtaining unit 51. In Embodiment 1, the temperature difference calculating unit 53 calculates a temperature difference $\Delta T_1$ between the indoor temperature and the indoor pipe temperature. Furthermore, the temperature difference calculating unit 53 calculates a temperature difference $\Delta T_2$ between the discharge temperature and the indoor pipe temperature.

The comparison unit 54 compares various pieces of information. In Embodiment 1, the comparison unit 54 compares the temperature difference $\Delta T_1$ calculated by the temperature difference calculating unit 53 with a first temperature difference threshold $T_{th1}$ stored in the storage unit 55. The first temperature difference threshold $T_{th1}$ is a predetermined value for the temperature difference $\Delta T_1$. Furthermore, the comparison unit 54 compares the temperature difference $\Delta T_2$ calculated by the temperature difference calculating unit 53 with a second temperature difference threshold $T_{th2}$ stored in the storage unit 55. The second temperature difference threshold $T_{th2}$ is a predetermined value for the temperature difference $\Delta T_2$. The first temperature difference threshold $T_{th1}$ and the second temperature difference threshold $T_{th2}$ are used to determine whether normal switching of the four-way valve 12, the first three-way valve 16*a*, and the second three-way valve 16*b* is done.

Furthermore, the comparison unit 54 compares the current value I supplied to the compressor 11, obtained by the information obtaining unit 51, with a current threshold $I_{th}$ stored in the storage unit 55. The current threshold $I_{th}$ is a predetermined value for the current value I and is used to determine whether the compressor 11 is likely to be under abnormal conditions.

The storage unit 55 stores various values to be used in the units of the outdoor controller 50. In Embodiment 1, the storage unit 55 stores the first temperature difference threshold $T_{th1}$, the second temperature difference threshold $T_{th2}$, and the current threshold $I_{th}$, which are used by the comparison unit 54.

Figure 3:
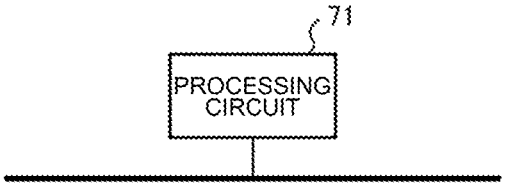
FIG. 3 is a hardware configuration diagram illustrating an exemplary configuration of the outdoor controller in FIG. 2.

FIG. 3 is a hardware configuration diagram illustrating an exemplary configuration of the outdoor controller 50 in FIG. 2. In the case where the various functions of the outdoor controller 50 are executed by hardware, the outdoor controller 50 in FIG. 2 includes a processing circuit 71 as illustrated in FIG. 3. In the outdoor controller 50 in FIG. 2, the processing circuit 71 implements the functions of the information obtaining unit 51, the operation status determining unit 52, the temperature difference calculating unit 53, the comparison unit 54, and the storage unit 55.

In the case where the functions are executed by hardware, the processing circuit 71 corresponds to, for example, a single circuit, a composite circuit, a programmed processor, a parallel-programmed processor, an application specific integrated circuit (ASIC), a field-programmable gate array (FPGA), or a combination thereof. In the outdoor controller 50, the functions of the information obtaining unit 51, the operation status determining unit 52, the temperature difference calculating unit 53, the comparison unit 54, and the storage unit 55 may be implemented by individual processing circuits 71. The functions of the units may be implemented by a single processing circuit 71.

Figure 4:
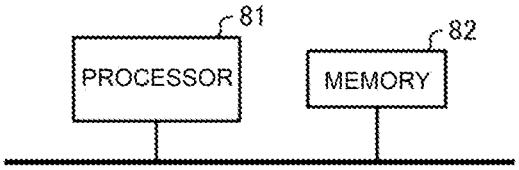
FIG. 4 is a hardware configuration diagram illustrating another exemplary configuration of the outdoor controller in FIG. 2.

FIG. 4 is a hardware configuration diagram illustrating another exemplary configuration of the outdoor controller 50 in FIG. 2. In the case where the various functions of the outdoor controller 50 are executed by software, the outdoor controller 50 in FIG. 2 includes a processor 81 and a memory 82 as illustrated in FIG. 4. In the outdoor controller 50, the processor 81 and the memory 82 implement the functions of the information obtaining unit 51, the operation status determining unit 52, the temperature difference calculating unit 53, the comparison unit 54, and the storage unit 55.

In the case where the functions are executed by software, the functions of the information obtaining unit 51, the operation status determining unit 52, the temperature difference calculating unit 53, the comparison unit 54, and the storage unit 55 in the outdoor controller 50 are implemented by software, firmware, or a combination of software and firmware. Software and firmware are described as programs and are stored in the memory 82. The processor 81 reads the programs stored in the memory 82 and runs the programs, thus implementing the functions.

Examples of the memory 82 include nonvolatile and volatile semiconductor memories, such as a random access memory (RAM), a read-only memory (ROM), a flash memory, an erasable and programmable ROM (EPROM), and an electrically erasable and programmable ROM (EEPROM). As the memory 82, for example, a removable recording medium, such as a magnetic disk, a flexible disk, an optical disc, a compact disc (CD), a MiniDisc (MD), or a digital versatile disc (DVD), may be used.

[Operations of Air-Conditioning Apparatus 100]

Operations of the air-conditioning apparatus 100 with the above-described configuration will now be described. Operations of the air-conditioning apparatus 100 in the heating operation, the defrosting operation, and the heating-defrosting simultaneous operation will be described below. An operation of the air-conditioning apparatus 100 in the cooling operation is the same as that in the defrosting operation, and description thereof is omitted accordingly.

(Heating Operation)

Figure 5:
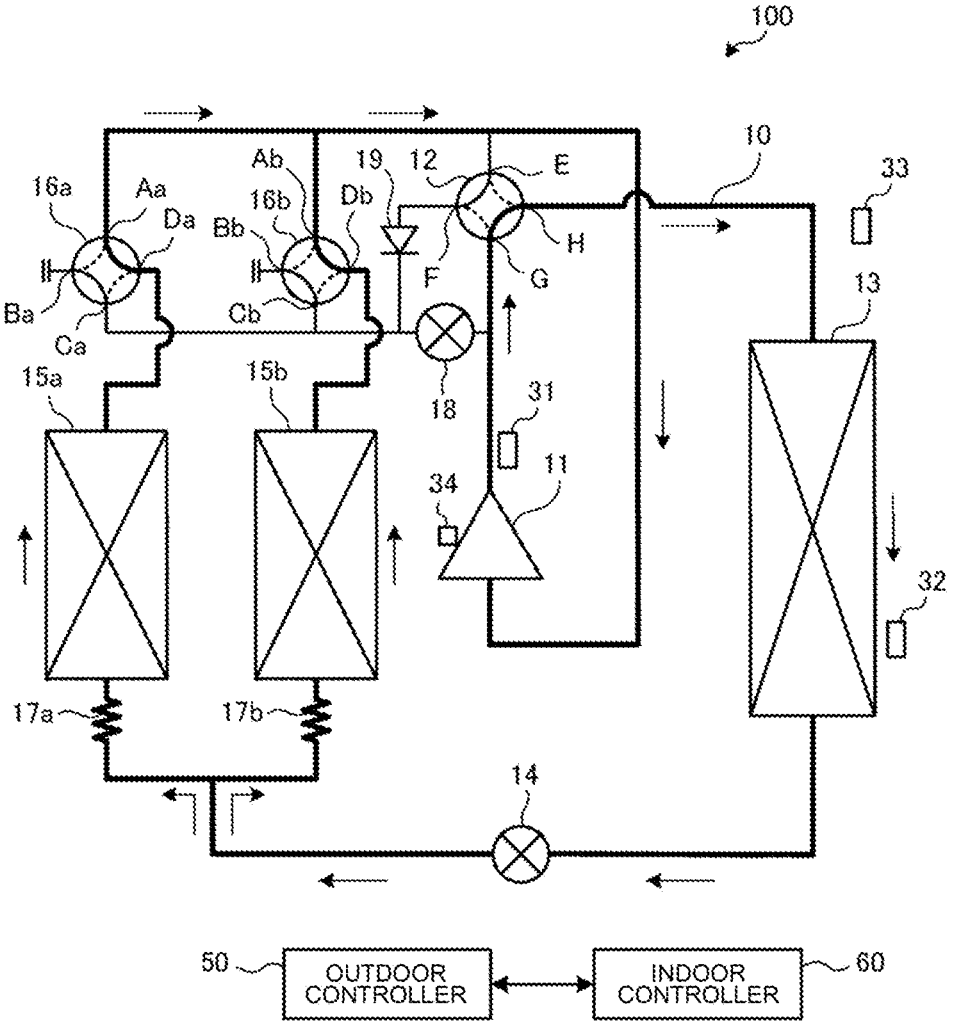
FIG. 5 is a schematic diagram explaining the flow of refrigerant in a heating operation in the air-conditioning apparatus according to Embodiment 1.

The operation of the air-conditioning apparatus 100 in the heating operation will now be described. The heating operation is an operation in which the refrigerant flows through the refrigerant circuit 10 to heat the indoor air. FIG. 5 is a schematic diagram explaining the flow of the refrigerant in the heating operation in the air-conditioning apparatus according to Embodiment 1. In FIG. 5, thick lines represent refrigerant flow paths, and arrows represent the refrigerant flow direction. The refrigerant flow paths and the refrigerant flow direction in FIGS. 6 and 7, which will be described later, are represented in the same manner.

As illustrated in FIG. 5, in the heating operation, the four-way valve 12 is set at the first position, where the first port G communicates with the fourth port H, and the second port E communicates with the third port F. The first three-way valve 16*a* and the second three-way valve 16*b* are set at the first position. In the first three-way valve 16*a*, the sixth port Aa communicates with the seventh port Da, and the fifth port Ca communicates with the eighth port Ba. In the second three-way valve 16*b*, the sixth port Ab communicates with the seventh port Db, and the fifth port Cb communicates with the eighth port Bb. The bypass expansion valve 18 is set at, for example, but not limited to, an open position. The bypass expansion valve 18 may be set at a closed position.

High-pressure gas refrigerant discharged from the compressor 11 passes through the four-way valve 12 and flows into the indoor heat exchanger 13. In the heating operation, the indoor heat exchanger 13 operates as a condenser. Specifically, in the indoor heat exchanger 13, the refrigerant flowing therethrough exchanges heat with the indoor air sent by the indoor fan (not illustrated), so that the heat of condensation of the refrigerant is transferred to the indoor air. Thus, once in the indoor heat exchanger 13, the gas refrigerant condenses into high-pressure liquid refrigerant. The indoor air sent by the indoor fan is heated by the heat transferred from the refrigerant.

The liquid refrigerant leaving the indoor heat exchanger 13 enters the expansion valve 14. The refrigerant is reduced in pressure into low-pressure, two-phase refrigerant by the expansion valve 14. The two-phase refrigerant leaving the expansion valve 14 is divided into two streams. One stream of the two-phase refrigerant is further reduced in pressure through the capillary tube 17*a* and then enters the first outdoor heat exchanger 15*a*. The other stream of the two-phase refrigerant is further reduced in pressure through the capillary tube 17*b* and then enters the second outdoor heat exchanger 15*b*.

In the heating operation, the first outdoor heat exchanger 15*a* and the second outdoor heat exchanger 15*b* each operate as an evaporator. Specifically, in each of the first outdoor heat exchanger 15*a* and the second outdoor heat exchanger 15*b*, the refrigerant flowing therethrough exchanges heat with the outdoor air sent by the outdoor fan (not illustrated), and receives heat for evaporation from the outdoor air. Thus, the two-phase refrigerant flowing through each of the first outdoor heat exchanger 15*a* and the second outdoor heat exchanger 15*b* evaporates into low-pressure gas refrigerant.

The two streams of the gas refrigerant leaving the first outdoor heat exchanger 15*a* and the second outdoor heat exchanger 15*b* pass through the first three-way valve 16*a* and the second three-way valve 16*b*, respectively, and then join together. After that, the refrigerant is sucked into the compressor 11. In the compressor 11, the sucked gas refrigerant is compressed into high-pressure gas refrigerant. In the heating operation, the above-described cycle is continuously repeated.

Such a heating operation continued for a long time may cause the first outdoor heat exchanger 15*a* and the second outdoor heat exchanger 15*b* to be frosted, resulting in a reduction in heat exchange efficiency of the first outdoor heat exchanger 15*a* and the second outdoor heat exchanger 15*b*. For this reason, the air-conditioning apparatus 100 according to Embodiment 1 periodically performs the defrosting operation or the heating-defrosting simultaneous operation to melt frost on the first outdoor heat exchanger 15*a* and the second outdoor heat exchanger 15*b*.

(Defrosting Operation)

Figure 6:
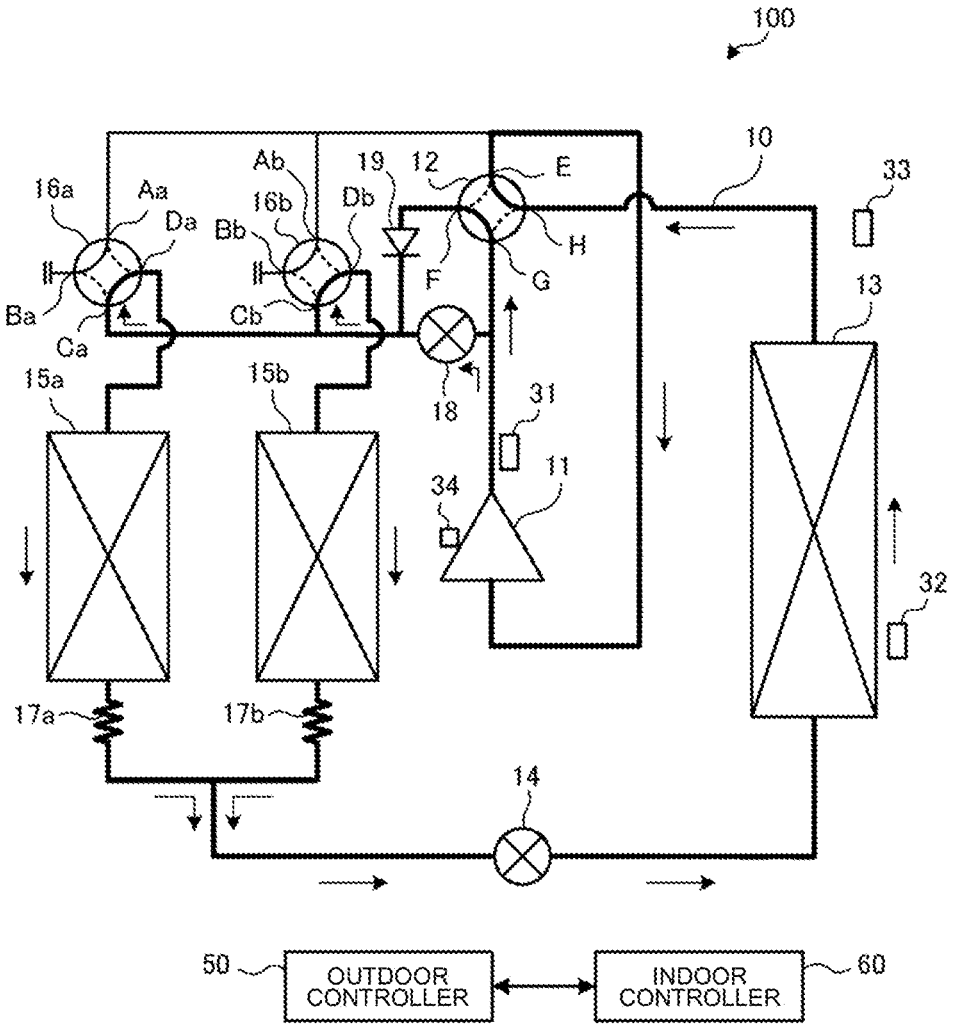
FIG. 6 is a schematic diagram explaining the flow of the refrigerant in a defrosting operation in the air-conditioning apparatus according to Embodiment 1.

The operation of the air-conditioning apparatus 100 in the defrosting operation will now be described. The defrosting operation is an operation to remove frost on both the first outdoor heat exchanger 15*a* and the second outdoor heat exchanger 15*b*. FIG. 6 is a schematic diagram explaining the flow of the refrigerant in the defrosting operation in the air-conditioning apparatus according to Embodiment 1.

As illustrated in FIG. 6, in the defrosting operation, the four-way valve 12 is set at the second position, where the first port G communicates with the third port F, and the second port E communicates with the fourth port H. The first three-way valve 16*a* and the second three-way valve 16*b* are set at the second position. In the first three-way valve 16*a*, the sixth port Aa communicates with the eighth port Ba, and the fifth port Ca communicates with the seventh port Da. In the second three-way valve 16*b*, the sixth port Ab communicates with the eighth port Bb, and the fifth port Cb communicates with the seventh port Db. The bypass expansion valve 18 is set at, for example, the open position.

High-pressure gas refrigerant discharged from the compressor 11 is divided into two streams, one stream flowing in a direction to the bypass expansion valve 18 and a second stream flowing in a direction to the four-way valve 12. The gas refrigerant leaving the four-way valve 12 passes through the check valve 19 and then joins the gas refrigerant leaving the bypass expansion valve 18 on the downstream side of the bypass expansion valve 18. After joining on the downstream side of the bypass expansion valve 18, the gas refrigerant is divided into two streams, one stream flowing in a first direction to the first three-way valve 16*a* and a second stream flowing in a second direction to the second three-way valve 16*b*.

The gas refrigerant flowing in the first direction passes through the first three-way valve 16*a* and then enters the first outdoor heat exchanger 15*a*. The gas refrigerant flowing in the second direction passes through the second three-way valve 16*b* and then enters the second outdoor heat exchanger 15*b*. In the defrosting operation, the first outdoor heat exchanger 15*a* and the second outdoor heat exchanger 15*b* each operate as a condenser. Specifically, in the first outdoor heat exchanger 15*a* and the second outdoor heat exchanger 15*b*, the refrigerant flowing therethrough transfers heat to melt frost on the first outdoor heat exchanger 15*a* and the second outdoor heat exchanger 15*b*. Thus, the first outdoor heat exchanger 15*a* and the second outdoor heat exchanger 15*b* are defrosted. Once in the first outdoor heat exchanger 15*a* and the second outdoor heat exchanger 15*b*, the gas refrigerant condenses into liquid refrigerant.

The liquid refrigerant leaving the first outdoor heat exchanger 15*a* is reduced in pressure through the capillary tube 17*a*. The liquid refrigerant leaving the second outdoor heat exchanger 15*b* is reduced in pressure through the capillary tube 17*b*. The liquid refrigerant reduced in pressure through the capillary tube 17*a* joins the liquid refrigerant reduced in pressure through the capillary tube 17*b*. Then, the refrigerant enters the expansion valve 14. Once in the expansion valve 14, the liquid refrigerant is further reduced in pressure into low-pressure, two-phase refrigerant. The two-phase refrigerant leaving the expansion valve 14 enters the indoor heat exchanger 13. In the defrosting operation, the indoor heat exchanger 13 operates as an evaporator. Specifically, in the indoor heat exchanger 13, the refrigerant flowing therethrough removes heat for evaporation from the indoor air. Thus, once in the indoor heat exchanger 13, the two-phase refrigerant evaporates into low-pressure gas refrigerant.

The gas refrigerant leaving the indoor heat exchanger 13 passes through the four-way valve 12 and is sucked into the compressor 11. The sucked gas refrigerant is compressed into high-pressure gas refrigerant by the compressor 11. In the defrosting operation, the above-described cycle is continuously repeated. As described above, since both the first outdoor heat exchanger 15*a* and the second outdoor heat exchanger 15*b* are supplied with high-temperature, high-pressure gas refrigerant in the defrosting operation, both the first outdoor heat exchanger 15*a* and the second outdoor heat exchanger 15*b* are defrosted by heat transferred from the refrigerant.

(Heating-Defrosting Simultaneous Operation)

Figure 7:
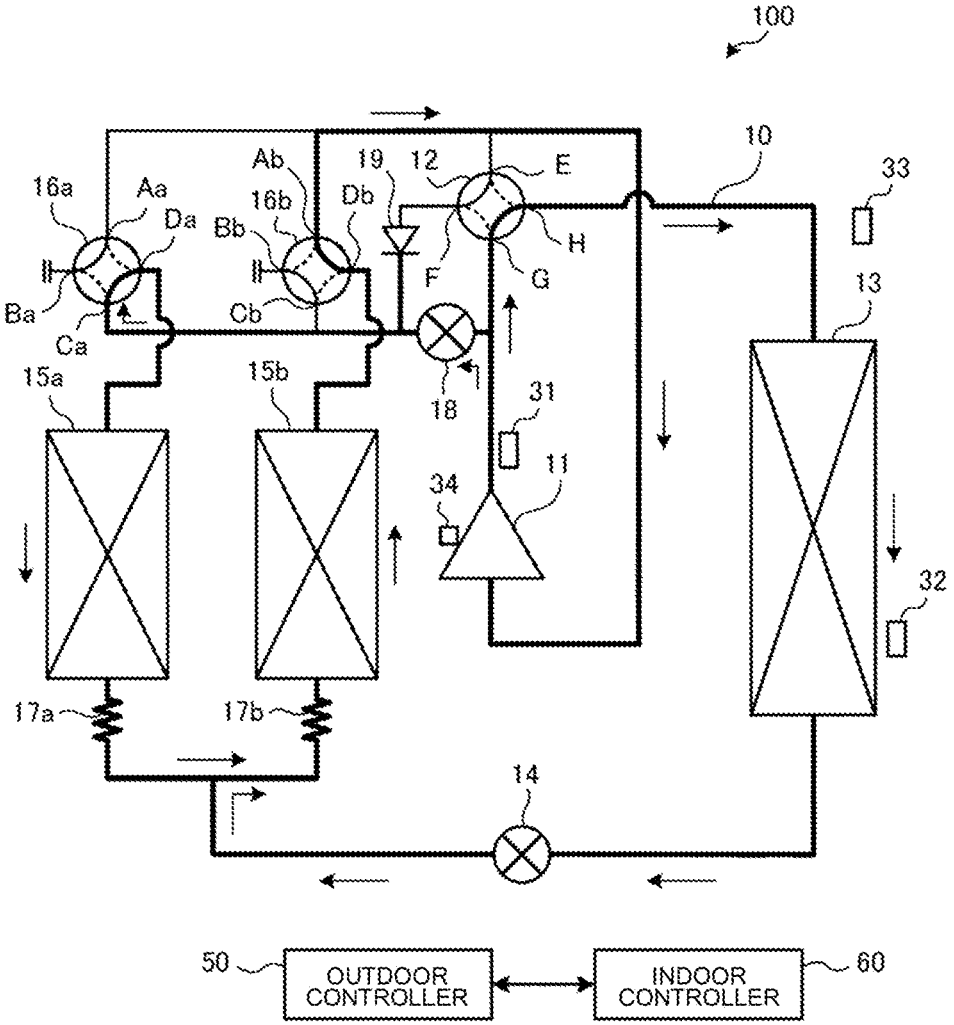
FIG. 7 is a schematic diagram explaining the flow of the refrigerant in a heating-defrosting simultaneous operation in the air-conditioning apparatus according to Embodiment 1.

The operation of the air-conditioning apparatus 100 in the heating-defrosting simultaneous operation will now be described. The heating-defrosting simultaneous operation is an operation in which the defrosting operation for one of the first outdoor heat exchanger 15*a* and the second outdoor heat exchanger 15*b* and the heating operation using the other outdoor heat exchanger are performed at the same time. FIG. 7 is a schematic diagram explaining the flow of the refrigerant in the heating-defrosting simultaneous operation in the air-conditioning apparatus according to Embodiment 1.

The heating-defrosting simultaneous operation includes a first operation and a second operation. In the first operation, the first outdoor heat exchanger 15*a* and the indoor heat exchanger 13 operate as condensers, and the second outdoor heat exchanger 15*b* operates as an evaporator. Thus, the first outdoor heat exchanger 15*a* is defrosted, and heating is continued. In the second operation, the second outdoor heat exchanger 15*b* and the indoor heat exchanger 13 operate as condensers, and the first outdoor heat exchanger 15*a* operates as an evaporator. Thus, the second outdoor heat exchanger 15*b* is defrosted, and heating is continued. FIG. 7 illustrates the operation in the first operation of the heating-defrosting simultaneous operation.

As illustrated in FIG. 7, in the heating-defrosting simultaneous operation, the four-way valve 12 is set at the first position, where the first port G communicates with the fourth port H, and the second port E communicates with the third port F. The first three-way valve 16*a* and the second three-way valve 16*b* are set at the third position. In the first three-way valve 16*a*, the sixth port Aa communicates with the eighth port Ba, and the fifth port Ca communicates with the seventh port Da. In the second three-way valve 16*b*, the sixth port Ab communicates with the seventh port Db, and the fifth port Cb communicates with the eighth port Bb. The bypass expansion valve 18 is set at the open position at a set opening degree.

Part of high-pressure gas refrigerant discharged from the compressor 11 enters the bypass expansion valve 18. Once in the bypass expansion valve 18, the gas refrigerant is reduced in pressure. The refrigerant passes through the first three-way valve 16*a* and then enters the first outdoor heat exchanger 15*a*. In the first outdoor heat exchanger 15*a*, the refrigerant flowing therethrough transfers heat to melt frost on the heat exchanger. Thus, the first outdoor heat exchanger 15*a* is defrosted. Once in the first outdoor heat exchanger 15*a*, the gas refrigerant condenses into high-pressure liquid refrigerant or two-phase refrigerant. Then, the refrigerant flows out of the first outdoor heat exchanger 15*a*. The refrigerant is reduced in pressure through the capillary tube 17*a*.

The other part of the high-pressure gas refrigerant discharged from the compressor 11 passes through the four-way valve 12 and enters the indoor heat exchanger 13. In the indoor heat exchanger 13, the refrigerant flowing therethrough exchanges heat with the indoor air sent by the indoor fan (not illustrated). The heat of condensation of the refrigerant is transferred to the indoor air. Thus, once in the indoor heat exchanger 13, the gas refrigerant condenses into high-pressure liquid refrigerant. The indoor air sent by the indoor fan is heated by the heat transferred from the refrigerant.

The liquid refrigerant leaving the indoor heat exchanger 13 enters the expansion valve 14. Once in the expansion valve 14, the liquid refrigerant is reduced in pressure into low-pressure, two-phase refrigerant. The two-phase refrigerant leaving the expansion valve 14 joins the liquid refrigerant or two-phase refrigerant reduced in pressure through the capillary tube 17*a*. The refrigerant is further reduced in pressure through the capillary tube 17*b* and then enters the second outdoor heat exchanger 15*b*. In the second outdoor heat exchanger 15*b*, the refrigerant flowing therethrough exchanges heat with the outdoor air sent by the outdoor fan (not illustrated) and receives heat for evaporation from the outdoor air. Thus, once in the second outdoor heat exchanger 15*b*, the two-phase refrigerant evaporates into low-pressure gas refrigerant.

The gas refrigerant leaving the second outdoor heat exchanger 15*b* passes through the second three-way valve 16*b* and is then sucked into the compressor 11. The sucked gas refrigerant is compressed into high-pressure gas refrigerant by the compressor 11. In the first operation of the heating-defrosting simultaneous operation, the above-described cycle is continuously repeated to defrost the first outdoor heat exchanger 15*a* and continue heating.

Although not illustrated, in the second operation of the heating-defrosting simultaneous operation, the four-way valve 12 is set at the first position in a manner similar to that in the first operation. The first three-way valve 16*a* and the second three-way valve 16*b* are set at the fourth position. In the first three-way valve 16*a*, the sixth port Aa communicates with the seventh port Da, and the fifth port Ca communicates with the eighth port Ba. In the second three-way valve 16*b*, the sixth port Ab communicates with the eighth port Bb, and the fifth port Cb communicates with the seventh port Db. The bypass expansion valve 18 is set at the open position at the set opening degree in a manner similar to that in the first operation. Thus, in the second operation, the second outdoor heat exchanger 15*b* is defrosted, and heating is continued.

As described above, in the heating-defrosting simultaneous operation, one of the first outdoor heat exchanger 15*a* and the second outdoor heat exchanger 15*b* is supplied with high-temperature, high-pressure gas refrigerant. The other one of the first outdoor heat exchanger 15*a* and the second outdoor heat exchanger 15*b* operates as an evaporator. Thus, in the heating-defrosting simultaneous operation, while one of the outdoor heat exchangers is being defrosted, heating can be continued using the other outdoor heat exchanger.

[Valve Switching Failure]

Valve switching failure in the air-conditioning apparatus 100 according to Embodiment 1 will now be described. In the air-conditioning apparatus 100 according to Embodiment 1 upon switching between the operations, for example, from the cooling operation to the heating operation, a valve, such as the four-way valve 12, the first three-way valve 16*a*, or the second three-way valve 16*b*, may fail to switch normally for some reason. Under such conditions, the refrigerant may fail to flow normally through the refrigerant circuit 10, leading to a breakdown of the compressor 11.

Figure 8:
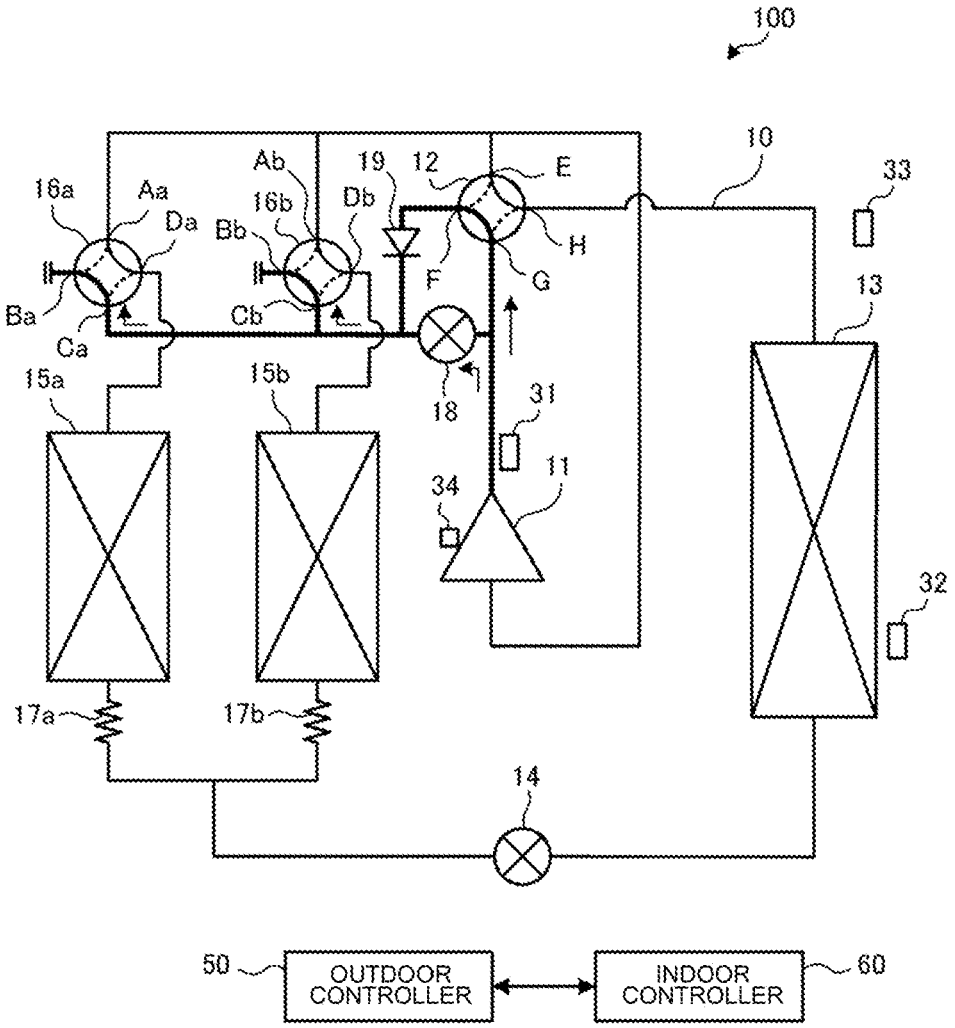
FIG. 8 is a refrigerant circuit diagram illustrating a first example of the flow of the refrigerant in the air-conditioning apparatus according to Embodiment 1 under valve switching failure conditions upon switching between operations.

FIG. 8 is a refrigerant circuit diagram illustrating a first example of the flow of the refrigerant in the air-conditioning apparatus according to Embodiment 1 under valve switching failure conditions upon switching between the operations. The first example corresponds to the flow of the refrigerant in the case where the four-way valve 12 is stuck and fails to switch when the cooling operation is switched to the heating operation or in the case where the first three-way valve 16*a* and the second three-way valve 16*b* are stuck and fail to switch when the heating operation is switched to the cooling operation.

As illustrated in FIG. 8, in this case, the four-way valve 12 is at the second position, where the first port G communicates with the third port F, and the second port E communicates with the fourth port H. The first three-way valve 16*a* and the second three-way valve 16*b* are at the first position. In the first three-way valve 16*a*, the sixth port Aa communicates with the seventh port Da, and the fifth port Ca communicates with the eighth port Ba. In the second three-way valve 16*b*, the sixth port Ab communicates with the seventh port Db, and the fifth port Cb communicates with the eighth port Bb.

The refrigerant discharged from the compressor 11 is divided into two streams, one stream flowing in the direction to the bypass expansion valve 18 and a second stream flowing in the direction to the four-way valve 12. The refrigerant flowing in the direction to the four-way valve 12 passes through the first port G and the third port F of the four-way valve 12 and then passes through the check valve 19. After that, the refrigerant joins the refrigerant leaving the bypass expansion valve 18 on the downstream side of the bypass expansion valve 18. After joining on the downstream side of the bypass expansion valve 18, the refrigerant is divided into two streams, one stream flowing in the first direction to the first three-way valve 16*a* and a second stream flowing in the second direction to the second three-way valve 16*b*.

At the first three-way valve 16*a*, the refrigerant flows into the fifth port Ca of the first three-way valve 16*a* and flows out of the eighth port Ba. The eighth port Ba of the first three-way valve 16*a* is closed to prevent the leakage of the refrigerant, and the refrigerant flowing out of the eighth port Ba is retained. At the second three-way valve 16*b*, the refrigerant flows into the fifth port Cb of the second three-way valve 16*b* and flows out of the eighth port Bb. The eighth port Bb of the second three-way valve 16*b* is closed to prevent the leakage of the refrigerant, and the refrigerant flowing out of the eighth port Bb is retained.

As described above, in the first example, the refrigerant discharged from the compressor 11 is retained just after leaving the first three-way valve 16*a* and the second three-way valve 16*b*, and fails to further flow through the refrigerant circuit 10. In other words, the refrigerant discharged from the compressor 11 is not sucked into the compressor 11. Continuous operation of the compressor 11 under such conditions may cause the compressor 11 to be at an abnormally high pressure, leading to a breakdown of the compressor.

Figure 9:
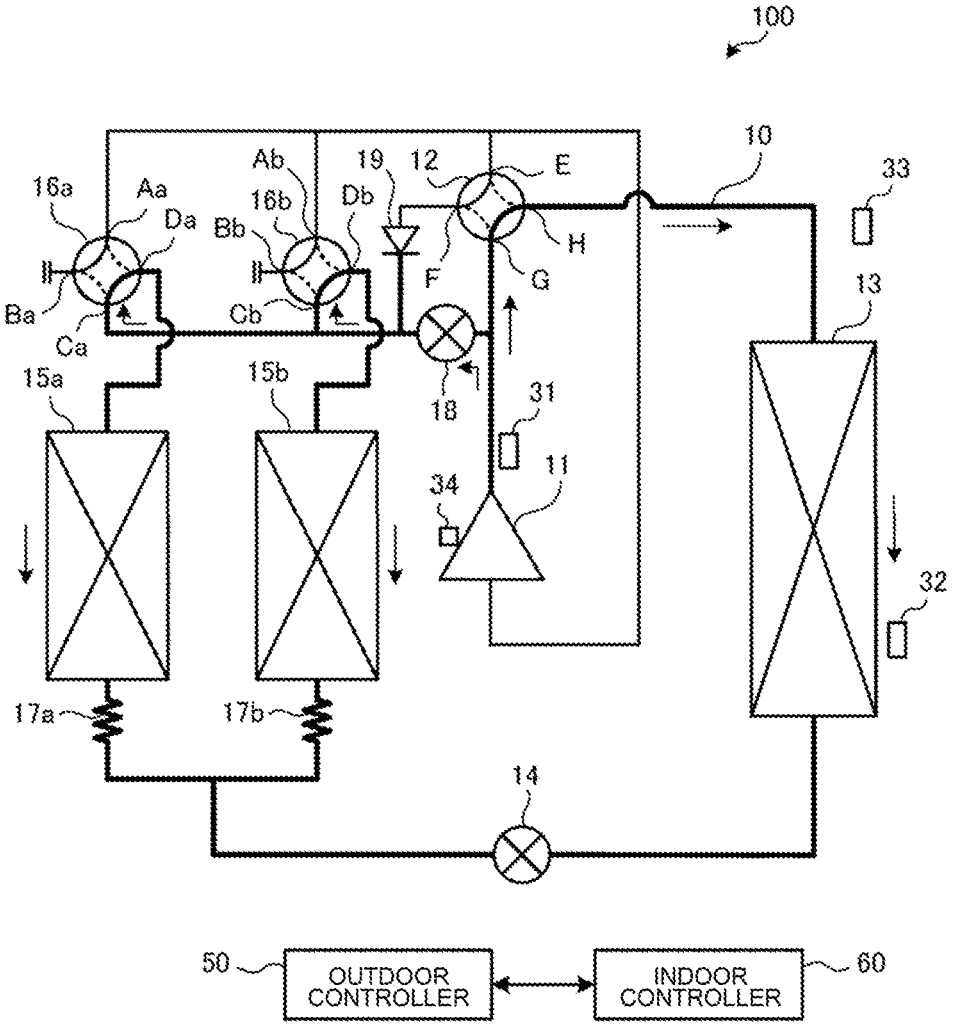
FIG. 9 is a refrigerant circuit diagram illustrating a second example of the flow of the refrigerant in the air-conditioning apparatus according to Embodiment 1 under valve switching failure conditions upon switching between the operations.

FIG. 9 is a refrigerant circuit diagram illustrating a second example of the flow of the refrigerant in the air-conditioning apparatus according to Embodiment 1 under valve switching failure conditions upon switching between the operations. The second example corresponds to the flow of the refrigerant in the case where the four-way valve 12 is stuck and fails to switch when the heating operation is switched to the cooling operation or in the case where the first three-way valve 16*a* and the second three-way valve 16*b* are stuck and fail to switch when the cooling operation is switched to the heating operation.

As illustrated in FIG. 9, in this case, the four-way valve 12 is at the first position, where the first port G communicates with the fourth port H and the second port E communicates with the third port F. The first three-way valve 16*a* and the second three-way valve 16*b* are at the second position. In the first three-way valve 16*a*, the sixth port Aa communicates with the eighth port Ba, and the fifth port Ca communicates with the seventh port Da. In the second three-way valve 16*b*, the sixth port Ab communicates with the eighth port Bb, and the fifth port Cb communicates with the seventh port Db.

The refrigerant discharged from the compressor 11 is divided into two streams, one stream flowing in the direction to the bypass expansion valve 18 and a second stream flowing in the direction to the four-way valve 12. The refrigerant flowing in the direction to the four-way valve 12 passes through the first port G and the fourth port H of the four-way valve 12 and then enters the indoor heat exchanger 13. For the refrigerant flowing in the direction to the bypass expansion valve 18, part of the refrigerant is retained by the check valve 19, and the other part of the refrigerant is divided into two streams, one stream flowing in the first direction to the first three-way valve 16*a* and a second stream flowing in the second direction to the second three-way valve 16*b*.

At the first three-way valve 16*a*, the refrigerant flows into the fifth port Ca of the first three-way valve 16*a* and flows out of the seventh port Da. The refrigerant leaving the first three-way valve 16*a* enters the first outdoor heat exchanger 15*a*. At the second three-way valve 16*b*, the refrigerant flows into the fifth port Cb of the second three-way valve 16*b* and flows out of the seventh port Db. The refrigerant leaving the second three-way valve 16*b* enters the second outdoor heat exchanger 15*b*.

If the refrigerant flows through the refrigerant circuit 10 as illustrated in FIG. 9, the refrigerant to be sucked into the compressor 11 will gradually decrease, resulting in the absence of refrigerant to be sucked into the compressor 11. Therefore, continuous operation of the compressor 11 under such conditions may cause the motor disposed inside the compressor 11 to be at an abnormally high temperature, leading to demagnetization of the motor. This may lead to a breakdown of the compressor.

In Embodiment 1, a valve switching failure detection process is performed to detect switching failure at the four-way valve 12, the first three-way valve 16*a*, or the second three-way valve 16*b*. This process is performed by the outdoor controller 50.

[Valve Switching Failure Detection Process]

The valve switching failure detection process will now be described. The valve switching failure detection process in Embodiment 1 includes a four-way-valve switching failure detection process for detecting switching failure at the four-way valve 12 and a three-way-valve switching failure detection process for detecting switching failure at the first three-way valve 16*a* and the second three-way valve 16*b*.

The four-way-valve switching failure detection process is performed to determine whether normal switching of the four-way valve 12 is done upon switching between the operations of the air-conditioning apparatus 100. The three-way-valve switching failure detection process is performed to determine whether normal switching of the first three-way valve 16*a* and the second three-way valve 16*b* is done upon switching between the operations of the air-conditioning apparatus 100.

(Four-Way-Valve Switching Failure Detection Process)

Figure 10:
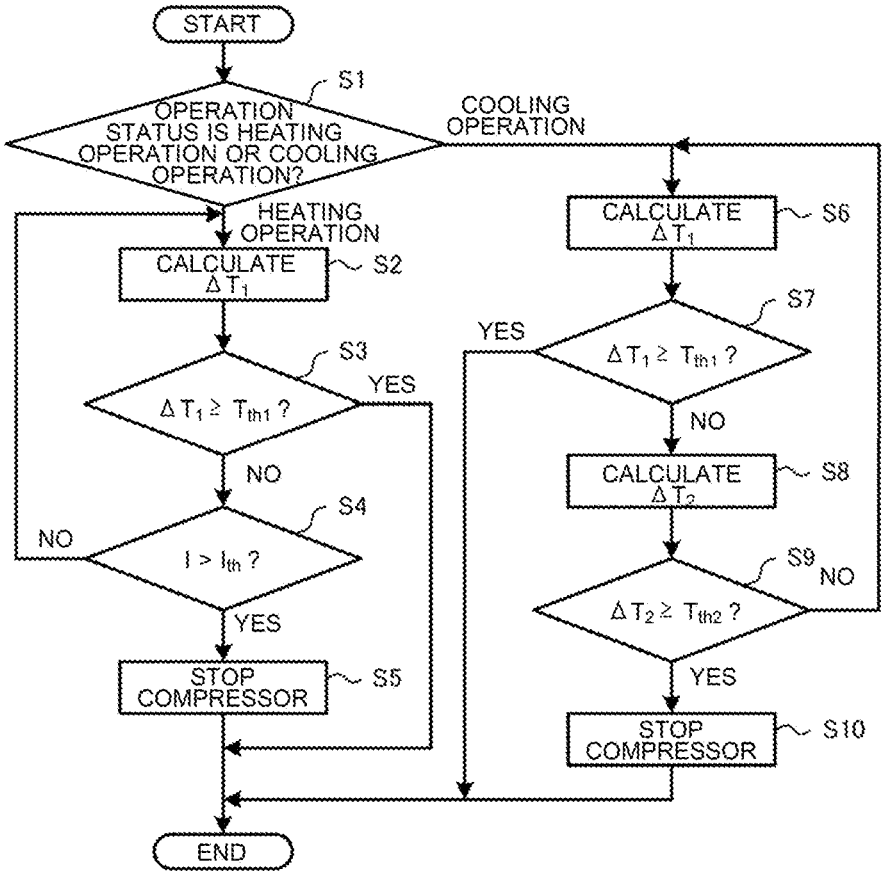
FIG. 10 is a flowchart illustrating an exemplary four-way-valve switching failure detection process by the air-conditioning apparatus according to Embodiment 1.

FIG. 10 is a flowchart illustrating an exemplary four-way-valve switching failure detection process by the air-conditioning apparatus according to Embodiment 1. In step S1, the operation status determining unit 52 of the outdoor controller 50 determines an operation status of the air-conditioning apparatus 100. In this example, the operation status determining unit 52 determines whether the operation status is the heating operation or the cooling operation. The determination operation is not limited to this example. The operation status determining unit 52 may determine which of the operations including the defrosting operation or the heating-defrosting simultaneous operation is the operation status of the air-conditioning apparatus 100.

If it is determined that the operation status of the air-conditioning apparatus 100 is the heating operation (step S1: heating operation), the process proceeds to step S2. If it is determined that the operation status of the air-conditioning apparatus 100 is the cooling operation (step S1: cooling operation), the process proceeds to step S6.

In step S2, the information obtaining unit 51 obtains the indoor temperature measured by the indoor temperature sensor 33 and the indoor pipe temperature measured by the indoor pipe temperature sensor 32. The temperature difference calculating unit 53 calculates the temperature difference $\Delta T_1$ between the obtained indoor temperature and indoor pipe temperature.

In step S3, the comparison unit 54 compares the temperature difference $\Delta T_1$ calculated by the temperature difference calculating unit 53 with the first temperature difference threshold $T_{th1}$ stored in the storage unit 55. As a result of comparison, if the temperature difference $\Delta T_1$ is greater than or equal to the first temperature difference threshold $T_{th1}$ (Yes in step S3), the outdoor controller 50 determines that the four-way valve 12 operates normally in the heating operation. The process including a series of operations is terminated.

If the temperature difference $\Delta T_1$ is less than the first temperature difference threshold $T_{th1}$ (No in step S3), the process proceeds to step S4. In step S4, the information obtaining unit 51 obtains the current value I to the compressor 11 measured by the current sensor 34. Then, the comparison unit 54 compares the current value I obtained by the information obtaining unit 51 with the current threshold $I_{th}$ stored in the storage unit 55.

As a result of comparison, if the current value I is greater than the current threshold $I_{th}$ (Yes in step S4), the outdoor controller 50 determines that the four-way valve 12 operates abnormally in the heating operation and the compressor 11 is accordingly likely to be at an abnormally high pressure, and then stops the compressor 11 in step S5. If the current value I is less than or equal to the current threshold $I_{th}$ (No in step S4), the process returns to step S2. The operations in steps S2 to S4 are repeated until the temperature difference $\Delta T_1$ is greater than or equal to the first temperature difference threshold $T_{th1}$.

In step S6, the information obtaining unit 51 obtains the indoor temperature measured by the indoor temperature sensor 33 and the indoor pipe temperature measured by the indoor pipe temperature sensor 32. The temperature difference calculating unit 53 calculates the temperature difference $\Delta T_1$ between the obtained indoor temperature and indoor pipe temperature.

In step S7, the comparison unit 54 compares the temperature difference $\Delta T_1$ calculated by the temperature difference calculating unit 53 with the first temperature difference threshold $T_{th1}$ stored in the storage unit 55. As a result of comparison, if the temperature difference $\Delta T_1$ is greater than or equal to the first temperature difference threshold $T_{th1}$ (Yes in step S7), the outdoor controller 50 determines that the four-way valve 12 operates normally in the cooling operation. The process including such a series of operations is terminated.

If the temperature difference $\Delta T_1$ is less than the first temperature difference threshold $T_{th1}$ (No in step S7), the process proceeds to step S8. In step S8, the information obtaining unit 51 obtains the discharge temperature of the refrigerant discharged from the compressor 11 measured by the discharge temperature sensor 31 and the indoor pipe temperature measured by the indoor pipe temperature sensor 32. The temperature difference calculating unit 53 calculates the temperature difference $\Delta T_2$ between the obtained discharge temperature and indoor pipe temperature.

In step S9, the comparison unit 54 compares the temperature difference $\Delta T_2$ calculated by the temperature difference calculating unit 53 with the second temperature difference threshold $T_{th2}$ stored in the storage unit 55. As a result of comparison, if the temperature difference $\Delta T_2$ is greater than or equal to the second temperature difference threshold $T_{th2}$ (Yes in step S9), the outdoor controller 50 determines that the four-way valve 12 operates abnormally in the cooling operation and accordingly determines that the temperature of the motor in the compressor 11 is likely to reach an abnormally high temperature because the refrigerant does not return to the compressor 11. In step S10, the outdoor controller 50 stops the compressor 11. If the temperature difference $\Delta T_2$ is less than the second temperature difference threshold $T_{th2}$ (No in step S9), the process returns to step S6. The operations in steps S6 to S9 are repeated until the temperature difference $\Delta T_1$ is greater than or equal to the first temperature difference threshold $T_{th1}$.

As described above, in the four-way-valve switching failure detection process, during the heating operation, when the temperature difference $\Delta T_1$ between the indoor temperature and the indoor pipe temperature is less than the first temperature difference threshold $T_{th1}$ and the current value I to the compressor 11 is greater than the current threshold $I_{th}$, switching failure at the four-way valve 12 is detected.

As illustrated in FIG. 8, switching failure at the four-way valve 12 upon switching to the heating operation of the air-conditioning apparatus 100 causes the refrigerant discharged from the compressor 11 to be retained at the first three-way valve 16*a* and the second three-way valve 16*b*. Under such conditions, the refrigerant does not flow into and out of the indoor heat exchanger 13, so that the indoor pipe temperature is not increased by the refrigerant flowing through the indoor heat exchanger 13 and approximates the indoor temperature. In other words, the temperature difference $\Delta T_1$ between the indoor temperature and the indoor pipe temperature is small.

Since the refrigerant discharged from the compressor 11 is retained at the first three-way valve 16*a* and the second three-way valve 16*b*, a passage at a discharge portion of the compressor 11 experiences high-pressure conditions. Consequently, the discharge pressure of the compressor 11 is subjected to high-pressure conditions. At this time, since the compressor 11 discharges the refrigerant at the discharge portion under high-pressure conditions, the current value I increases abnormally.

Therefore, in Embodiment 1, when the operation status of the air-conditioning apparatus 100 is the heating operation, when the temperature difference $\Delta T_1$ is small (the temperature difference $\Delta T_1$ is less than the first temperature difference threshold $T_{th1}$), and the current value I is abnormally high (the current value I is greater than the current threshold $I_{th}$), the occurrence of switching failure at the four-way valve 12 can be determined.

In the four-way-valve switching failure detection process, during the cooling operation, when the temperature difference $\Delta T_1$ between the indoor temperature and the indoor pipe temperature is less than the first temperature difference threshold $T_{th1}$ and the temperature difference $\Delta T_2$ between the discharge temperature of the compressor 11 and the indoor pipe temperature is greater than or equal to the second temperature difference threshold $T_{th2}$, switching failure at the four-way valve 12 is detected.

As illustrated in FIG. 9, switching failure at the four-way valve 12 upon switching to the cooling operation of the air-conditioning apparatus 100 causes the refrigerant discharged from the compressor 11 to be retained in the indoor heat exchanger 13, the first outdoor heat exchanger 15*a*, and the second outdoor heat exchanger 15*b*. Consequently, the refrigerant does not return to the compressor 11. Under such conditions, the refrigerant does not flow through the indoor heat exchanger 13, so that the indoor pipe temperature approximates the indoor temperature. In other words, the temperature difference $\Delta T_1$ between the indoor temperature and the indoor pipe temperature is small.

Since the refrigerant discharged from the compressor 11 is retained in the indoor heat exchanger 13, the first outdoor heat exchanger 15*a*, and the second outdoor heat exchanger 15*b*, the refrigerant does not return to the compressor 11. Consequently, the temperature of the motor in the compressor 11 increases because the motor in the compressor cannot be cooled with the refrigerant. The discharge temperature of the compressor 11 rises to a high temperature with increasing motor temperature.

Therefore, in Embodiment 1, when the operation status of the air-conditioning apparatus 100 is the cooling operation, when the temperature difference $\Delta T_1$ is small (the temperature difference $\Delta T_1$ is less than the first temperature difference threshold $T_{th1}$), and the discharge temperature of the compressor 11 is abnormally high (the temperature difference $\Delta T_2$ is greater than or equal to the second temperature difference threshold $T_{th2}$), the occurrence of switching failure at the four-way valve 12 can be determined.

(Three-Way-Valve Switching Failure Detection Process)

Figure 11:
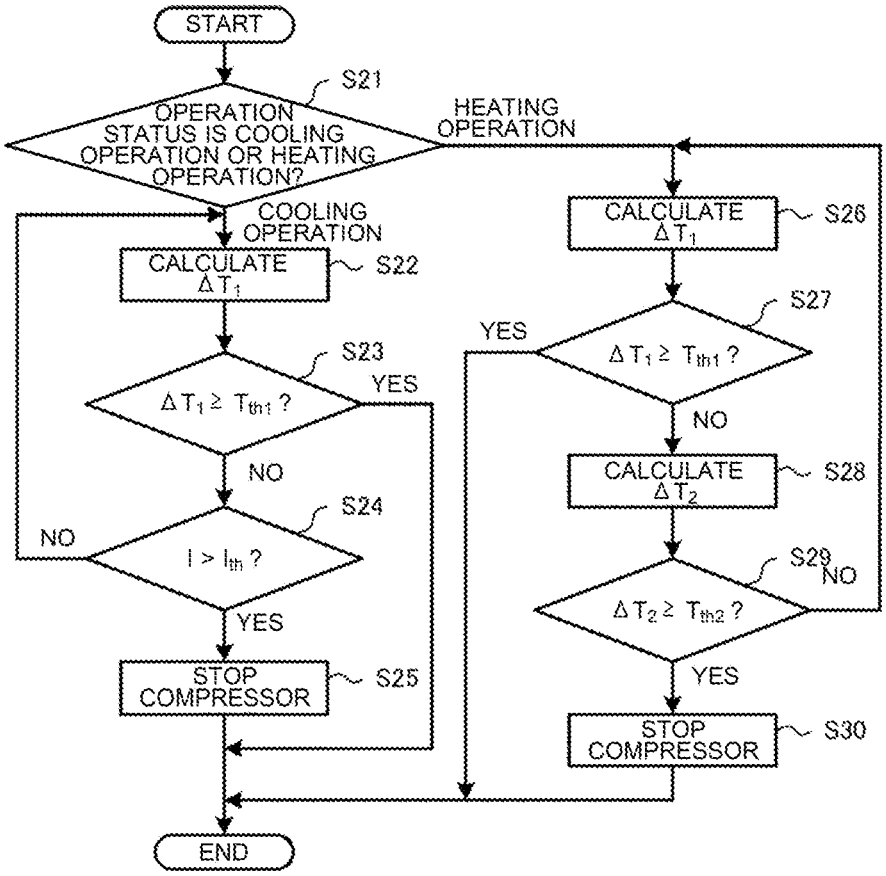
FIG. 11 is a flowchart illustrating an exemplary three-way-valve switching failure detection process by the air-conditioning apparatus according to Embodiment 1.

FIG. 11 is a flowchart illustrating an exemplary three-way-valve switching failure detection process by the air-conditioning apparatus according to Embodiment 1. In step S21, the operation status determining unit 52 determines an operation status of the air-conditioning apparatus 100. In this example, the operation status determining unit 52 determines whether the operation status is the cooling operation or the heating operation. The determination operation is not limited to this example. The operation status determining unit 52 may determine which of the operations including the defrosting operation or the heating-defrosting simultaneous operation is the operation status of the air-conditioning apparatus 100.

If it is determined that the operation status of the air-conditioning apparatus 100 is the cooling operation (step S21: cooling operation), the process proceeds to step S22. If it is determined that the operation status of the air-conditioning apparatus 100 is the heating operation (step S21: heating operation), the process proceeds to step S26.

In step S22, the information obtaining unit 51 obtains the indoor temperature measured by the indoor temperature sensor 33 and the indoor pipe temperature measured by the indoor pipe temperature sensor 32. The temperature difference calculating unit 53 calculates the temperature difference $\Delta T_1$ between the obtained indoor temperature and indoor pipe temperature.

In step S23, the comparison unit 54 compares the temperature difference $\Delta T_1$ calculated by the temperature difference calculating unit 53 with the first temperature difference threshold $T_{th1}$ stored in the storage unit 55. As a result of comparison, if the temperature difference $\Delta T_1$ is greater than or equal to the first temperature difference threshold $T_{th1}$ (Yes in step S23), the outdoor controller 50 determines that the first three-way valve 16*a* and the second three-way valve 16*b* operate normally in the cooling operation. The process including a series of operations is terminated.

If the temperature difference $\Delta T_1$ is less than the first temperature difference threshold $T_{th1}$ (No in step S23), the process proceeds to step S24. In step S24, the information obtaining unit 51 obtains the current value I to the compressor 11 measured by the current sensor 34. Then, the comparison unit 54 compares the current value I obtained by the information obtaining unit 51 with the current threshold $I_{th}$ stored in the storage unit 55. As a result of comparison, if the current value I is greater than the current threshold $I_{th}$ (Yes in step S24), the outdoor controller 50 determines that at least the first three-way valve 16*a* or the second three-way valve 16*b* operates abnormally in the cooling operation and the compressor 11 is accordingly likely to be at an abnormally high pressure, and then stops the compressor 11 in step S25. If the current value I is less than or equal to the current threshold $I_{th}$ (No in step S24), the process returns to step S22. The operations in steps S22 to S24 are repeated until the temperature difference $\Delta T_1$ is greater than or equal to the first temperature difference threshold $T_{th1}$.

In step S26, the information obtaining unit 51 obtains the indoor temperature measured by the indoor temperature sensor 33 and the indoor pipe temperature measured by the indoor pipe temperature sensor 32. The temperature difference calculating unit 53 calculates the temperature difference $\Delta T_1$ between the obtained indoor temperature and indoor pipe temperature.

In step S27, the comparison unit 54 compares the temperature difference $\Delta T_1$ calculated by the temperature difference calculating unit 53 with the first temperature difference threshold $T_{th1}$ stored in the storage unit 55. As a result of comparison, if the temperature difference $\Delta T_1$ is greater than or equal to the first temperature difference threshold $T_{th1}$ (Yes in step S27), the outdoor controller 50 determines that the first three-way valve 16*a* and the second three-way valve 16*b* operate normally in the heating operation. The process including such a series of operations is terminated.

If the temperature difference $\Delta T_1$ is less than the first temperature difference threshold $T_{th1}$ (No in step S27), the process proceeds to step S28. In step S28, the information obtaining unit 51 obtains the discharge temperature of the refrigerant discharged from the compressor 11 measured by the discharge temperature sensor 31 and the indoor pipe temperature measured by the indoor pipe temperature sensor 32. The temperature difference calculating unit 53 calculates the temperature difference $\Delta T_2$ between the obtained discharge temperature and indoor pipe temperature.

In step S29, the comparison unit 54 compares the temperature difference $\Delta T_2$ calculated by the temperature difference calculating unit 53 with the second temperature difference threshold $T_{th2}$ stored in the storage unit 55. As a result of comparison, if the temperature difference $\Delta T_2$ is greater than or equal to the second temperature difference threshold $T_{th2}$ (Yes in step S29), the outdoor controller 50 determines that at least the first three-way valve 16*a* or the second three-way valve 16*b* operates abnormally in the heating operation and accordingly determines that the temperature of the motor in the compressor 11 is likely to reach an abnormally high temperature because the refrigerant does not return to the compressor 11. In step S30, the outdoor controller 50 stops the compressor 11. If the temperature difference $\Delta T_2$ is less than the second temperature difference threshold $T_{th2}$ (No in step S29), the process returns to step S26. The operations in steps S26 to S29 are repeated until the temperature difference $\Delta T_1$ is greater than or equal to the first temperature difference threshold $T_{th1}$.

As described above, in the three-way-valve switching failure detection process, during the cooling operation, when the temperature difference $\Delta T_1$ between the indoor temperature and the indoor pipe temperature is less than the first temperature difference threshold $T_{th1}$ and the current value I to the compressor 11 is greater than the current threshold $I_{th}$, switching failure at at least the first three-way valve 16*a* or the second three-way valve 16*b* is detected.

As illustrated in FIG. 8, switching failure at at least the first three-way valve 16*a* or the second three-way valve 16*b* upon switching to the cooling operation of the air-conditioning apparatus 100 causes the refrigerant discharged from the compressor 11 to be retained at the first three-way valve 16*a* and the second three-way valve 16*b*. Under such conditions, the refrigerant does not flow into and out of the indoor heat exchanger 13, so that the indoor pipe temperature is not increased by the refrigerant flowing through the indoor heat exchanger 13 and approximates the indoor temperature. In other words, the temperature difference $\Delta T_1$ between the indoor temperature and the indoor pipe temperature is small.

Since the refrigerant discharged from the compressor 11 is retained at the first three-way valve 16*a* and the second three-way valve 16*b*, the passage at the discharge portion of the compressor 11 experiences high-pressure conditions. Consequently, the discharge pressure of the compressor 11 is subjected to high-pressure conditions. At this time, since the compressor 11 discharges the refrigerant at the discharge portion under high-pressure conditions, the current value I increases abnormally.

Therefore, in Embodiment 1, when the operation status of the air-conditioning apparatus 100 is the cooling operation, when the temperature difference $\Delta T_1$ is small (the temperature difference $\Delta T_1$ is less than the first temperature difference threshold $T_{th1}$), and the current value I is abnormally high (the current value I is greater than the current threshold $I_{th}$), the occurrence of switching failure at at least the first three-way valve 16*a* or the second three-way valve 16*b* can be determined.

In the three-way-valve switching failure detection process, during the heating operation, when the temperature difference $\Delta T_1$ between the indoor temperature and the indoor pipe temperature is less than the first temperature difference threshold $T_{th1}$ and the temperature difference $\Delta T_2$ between the discharge temperature of the compressor 11 and the indoor pipe temperature is greater than or equal to the second temperature difference threshold $T_{th2}$, switching failure at at least the first three-way valve 16*a* or the second three-way valve 16*b* is detected.

As illustrated in FIG. 9, switching failure at at least the first three-way valve 16*a* or the second three-way valve 16*b* upon switching to the heating operation of the air-conditioning apparatus 100 causes the refrigerant discharged from the compressor 11 to be retained in the indoor heat exchanger 13, the first outdoor heat exchanger 15*a*, and the second outdoor heat exchanger 15*b*. Consequently, the refrigerant does not return to the compressor 11. Under such conditions, the refrigerant does not flow through the indoor heat exchanger 13, so that the indoor pipe temperature approximates the indoor temperature. In other words, the temperature difference $\Delta T_1$ between the indoor temperature and the indoor pipe temperature is small.

Since the refrigerant discharged from the compressor 11 is retained in the indoor heat exchanger 13, the first outdoor heat exchanger 15*a*, and the second outdoor heat exchanger 15*b*, the refrigerant does not return to the compressor 11. Consequently, the temperature of the motor in the compressor 11 increases because the motor in the compressor cannot be cooled with the refrigerant. The discharge temperature of the compressor 11 rises to a high temperature with increasing motor temperature.

Therefore, in Embodiment 1, when the operation status of the air-conditioning apparatus 100 is the heating operation, when the temperature difference $\Delta T_1$ is small (the temperature difference $\Delta T_1$ is less than the first temperature difference threshold $T_{th1}$), and the discharge temperature of the compressor 11 is abnormally high (the temperature difference $\Delta T_2$ is greater than or equal to the second temperature difference threshold $T_{th2}$), the occurrence of switching failure at at least the first three-way valve 16*a* or the second three-way valve 16*b* can be determined.

In the above-described example in Embodiment 1, the four-way-valve switching failure detection process and the three-way-valve switching failure detection process are performed at different times. These processes may be performed in any other manner. For example, the four-way-valve switching failure detection process and the three-way-valve switching failure detection process may be performed at the same time.

Furthermore, if switching failure at any of the four-way valve 12, the first three-way valve 16*a*, and the second three-way valve 16*b* occurs repeatedly, a user may be informed of abnormality at any of the valves. Specifically, for example, when switching failure at any of the four-way valve 12, the first three-way valve 16*a*, and the second three-way valve 16*b* occurs repeatedly, the outdoor controller 50 transmits an abnormality detection signal representing abnormality at any of the valves to the indoor controller 60. In response to the received abnormality detection signal, the indoor controller 60 transmits information representing the abnormality to, for example, the remote control, which is operated by the user. Thus, the user who has received the information representing the abnormality can determine the cause of the abnormality.

As described above, in the air-conditioning apparatus 100 according to Embodiment 1, the outdoor controller 50 causes the discharge temperature sensor 31, the indoor pipe temperature sensor 32, and the indoor temperature sensor 33 to measure temperatures at some portions in the refrigerant circuit 10, and causes the current sensor 34 to measure a current to the compressor 11.

The outdoor controller 50 detects switching failure at the four-way valve 12 or at least the first three-way valve 16*a* or the second three-way valve 16*b* on the basis of the measurements and the operation status of the air-conditioning apparatus 100.

In Embodiment 1, when the measurements differ from measurements indicating normal switching of the valves, or normal operation of the valves, the outdoor controller 50 can detect switching failure at any of the valves. Specifically, the air-conditioning apparatus 100 according to Embodiment 1 can determine, based on, for example, temperatures measured at some portions in the refrigerant circuit 10, whether switching failure has occurred at any of the valves.

In Embodiment 1, during the heating operation, when the temperature difference $\Delta T_1$ between the indoor temperature and the indoor pipe temperature is less than the first temperature difference threshold $T_{th1}$ and the current value I is greater than the current threshold $I_{th}$, the outdoor controller 50 determines that switching failure has occurred at the four-way valve 12. As described above, the outdoor controller 50 can detect switching failure at the four-way valve 12 by determining the operation status, the indoor pipe temperature in the indoor heat exchanger 13, and the current value I to the compressor 11.

In Embodiment 1, during the cooling operation, when the temperature difference $\Delta T_1$ between the indoor temperature and the indoor pipe temperature is less than the first temperature difference threshold $T_{th1}$ and the temperature difference $\Delta T_2$ between the discharge temperature and the indoor pipe temperature is greater than or equal to the second temperature difference threshold $T_{th2}$, the outdoor controller 50 determines that switching failure has occurred at the four-way valve 12. As described above, the outdoor controller 50 can detect switching failure at the four-way valve 12 by determining the operation status, the indoor pipe temperature in the indoor heat exchanger 13, and the discharge temperature of the compressor 11.

In Embodiment 1, during the cooling operation, when the temperature difference $\Delta T_1$ between the indoor temperature and the indoor pipe temperature is less than the first temperature difference threshold $T_{th1}$ and the current value I is greater than the current threshold $I_{th}$, the outdoor controller 50 determines that switching failure has occurred at the first three-way valve 16*a* or the second three-way valve 16*b*. As described above, the outdoor controller 50 can detect switching failure at the first three-way valve 16*a* or the second three-way valve 16*b* by determining the operation status, the indoor pipe temperature in the indoor heat exchanger 13, and the current value I to the compressor 11.

In Embodiment 1, during the heating operation, when the temperature difference $\Delta T_1$ between the indoor temperature and the indoor pipe temperature is less than the first temperature difference threshold $T_{th1}$ and the temperature difference $\Delta T_2$ between the discharge temperature and the indoor pipe temperature is greater than or equal to the second temperature difference threshold $T_{th2}$, the outdoor controller 50 determines that switching failure has occurred at the first three-way valve 16*a* or the second three-way valve 16*b*. As described above, the outdoor controller 50 can detect switching failure at the first three-way valve 16*a* or the second three-way valve 16*b* by determining the operation status, the indoor pipe temperature in the indoor heat exchanger 13, and the discharge temperature of the compressor 11.

In Embodiment 1, when detecting switching failure at the four-way valve 12, the first three-way valve 16*a*, or the second three-way valve 16*b*, the outdoor controller 50 stops the compressor 11. This can reduce the risk of a breakdown of the compressor 11 caused by continuous operation of the air-conditioning apparatus 100.

Embodiment 2

Embodiment 2 will now be described. Embodiment 2 differs from Embodiment 1 in that a valve switching failure detection process is performed based on the temperature of the pipe between the first outdoor heat exchanger 15*a* and the first three-way valve 16*a* and the temperature of the pipe between the second outdoor heat exchanger 15*b* and the second three-way valve 16*b*. In Embodiment 2, parts that are common to Embodiment 1 are designated by the same reference signs, and detailed description thereof is omitted.

[Configuration of Air-Conditioning Apparatus 100]

Figure 12:
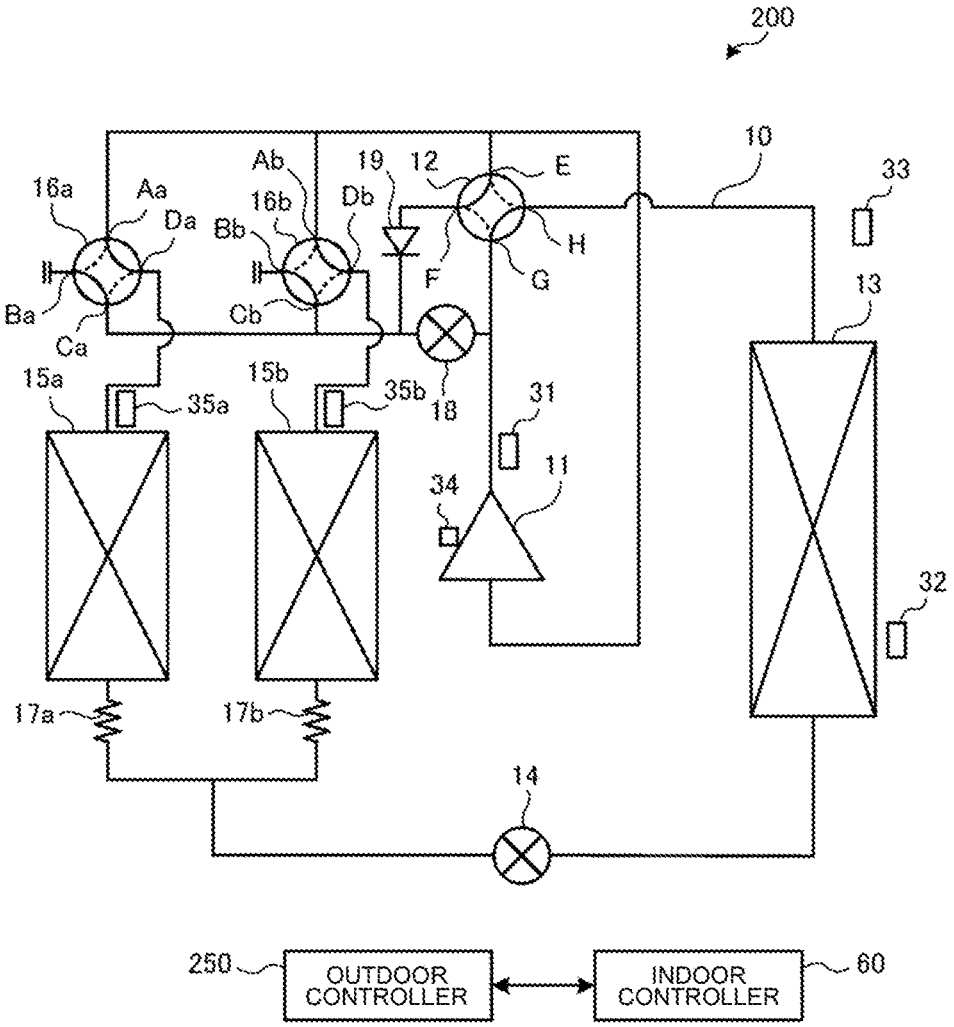
FIG. 12 is a refrigerant circuit diagram illustrating an exemplary configuration of an air-conditioning apparatus according to Embodiment 2.

FIG. 12 is a refrigerant circuit diagram illustrating an exemplary configuration of an air-conditioning apparatus according to Embodiment 2. As illustrated in FIG. 12, an air-conditioning apparatus 200 according to Embodiment 2 includes the refrigerant circuit 10, an outdoor controller 250, the indoor controller 60, the discharge temperature sensor 31, the indoor pipe temperature sensor 32, the indoor temperature sensor 33, and the current sensor 34.

(First Outdoor Pipe Temperature Sensor 35*a* and Second Outdoor Pipe Temperature Sensor 35*b*)

The air-conditioning apparatus 200 further includes a first outdoor pipe temperature sensor 35*a* and a second outdoor pipe temperature sensor 35*b*. The first outdoor pipe temperature sensor 35*a* is disposed at the pipe connecting the first outdoor heat exchanger 15*a* to the seventh port Da of the first three-way valve 16*a*, and measures a surface temperature of the pipe. The second outdoor pipe temperature sensor 35*b* is disposed at the pipe connecting the second outdoor heat exchanger 15*b* to the seventh port Db of the second three-way valve 16*b*, and measures a surface temperature of the pipe. In the following description, the surface temperature measured by the first outdoor pipe temperature sensor 35*a* and the surface temperature measured by the second outdoor pipe temperature sensor 35*b* may be referred to as "first surface temperature" and "second surface temperature", respectively.

(Outdoor Controller 250)

Like the outdoor controller 50 in Embodiment 1, the outdoor controller 250 receives information on a temperature measured by the discharge temperature sensor 31 and information on a current to the compressor 11 measured by the current sensor 34. In Embodiment 2, the outdoor controller 250 receives information on the first surface temperature measured by the first outdoor pipe temperature sensor 35*a* and the second surface temperature measured by the second outdoor pipe temperature sensor 35*b*.

Figure 13:
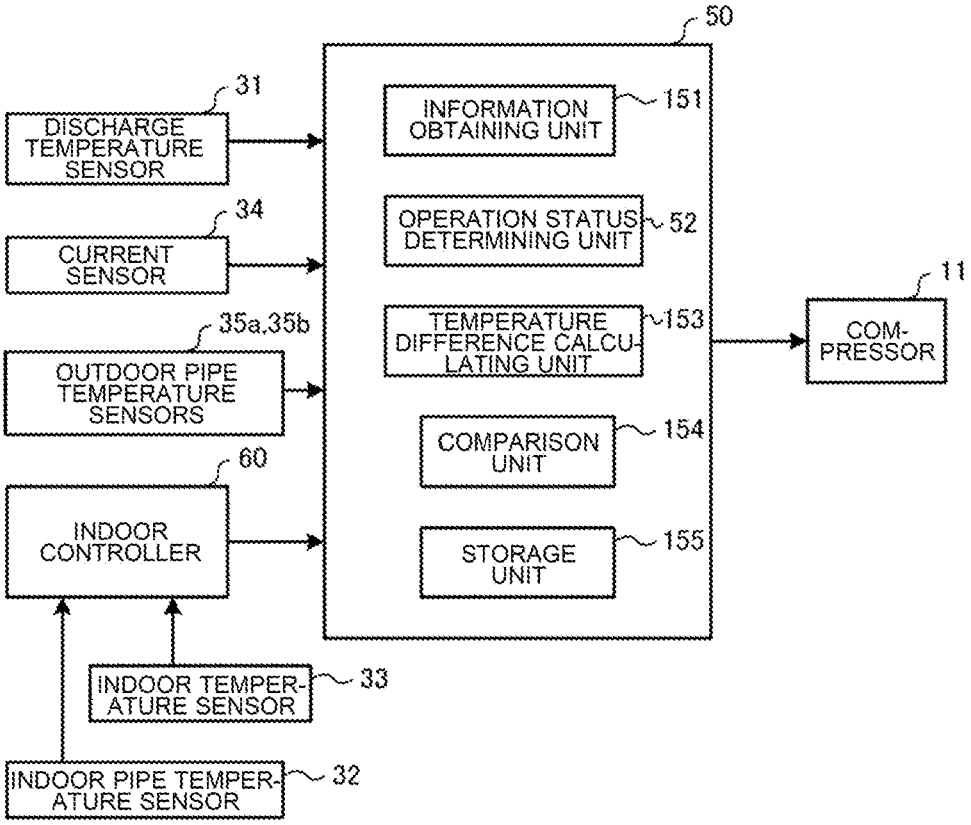
FIG. 13 is a functional block diagram illustrating an exemplary configuration of an outdoor controller in FIG. 12.

FIG. 13 is a functional block diagram illustrating an exemplary configuration of the outdoor controller in FIG. 12. As illustrated in FIG. 13, the outdoor controller 250 includes an information obtaining unit 151, the operation status determining unit 52, a temperature difference calculating unit 153, a comparison unit 154, and a storage unit 155. The outdoor controller 250 is configured as, for example, an arithmetic unit, such as a microcomputer that runs software to implement a variety of functions, or hardware, such as circuit devices corresponding to the functions. In FIG. 13, the components for the functions related to Embodiment 2 are illustrated, and depiction of the other components is omitted.

The information obtaining unit 151 obtains the surface temperatures measured by the first outdoor pipe temperature sensor 35*a* and the second outdoor pipe temperature sensor 35*b* in addition to the various pieces of information obtained by the information obtaining unit 51 in Embodiment 1.

Like the temperature difference calculating unit 53 in Embodiment 1, the temperature difference calculating unit 153 calculates the temperature difference $\Delta T_1$ between the indoor temperature and the indoor pipe temperature. In Embodiment 2, the temperature difference calculating unit 153 calculates a temperature difference $\Delta T_{3a}$ between the discharge temperature measured by the discharge temperature sensor 31 and the first surface temperature measured by the first outdoor pipe temperature sensor 35*a*. Furthermore, the temperature difference calculating unit 153 calculates a temperature difference $\Delta T_{3b}$ between the discharge temperature measured by the discharge temperature sensor 31 and the second surface temperature measured by the second outdoor pipe temperature sensor 35*b*.

The comparison unit 154 compares the various pieces of information. Like the comparison unit 54 in Embodiment 1, the comparison unit 154 compares the temperature difference $\Delta T_1$ with the first temperature difference threshold $T_{th1}$ and compares the current value I with the current threshold $I_{th}$.

Furthermore, in Embodiment 2, the comparison unit 154 compares the temperature differences $\Delta T_{3a}$ and $\Delta T_{3b}$, calculated by the temperature difference calculating unit 153, with a third temperature difference threshold $T_{th3}$ stored in the storage unit 155. The third temperature difference threshold $T_{th3}$ is a predetermined value for the temperature differences $\Delta T_{3a}$ and $\Delta T_{3b}$. The third temperature difference threshold $T_{th3}$ is a value used to determine whether normal switching of the four-way valve 12, the first three-way valve 16*a*, and the second three-way valve 16*b* is done.

Like the storage unit 55 in Embodiment 1, the storage unit 155 stores the first temperature difference threshold $T_{th1}$ and the current threshold $I_{th}$. In Embodiment 2, the storage unit 155 further stores the third temperature difference threshold $T_{th3}$, which is used by the comparison unit 154.

As in Embodiment 1, the units included in the outdoor controller 250 may be implemented by the processing circuit 71, which is illustrated in FIG. 3. The units included in the outdoor controller 250 may be implemented by the processor 81 and the memory 82 illustrated in FIG. 4.

[Valve Switching Failure Detection Process]

A valve switching failure detection process by the air-conditioning apparatus 200 according to Embodiment 2 will now be described. As in Embodiment 1, the valve switching failure detection process in Embodiment 2 includes a four-way-valve switching failure detection process for detecting switching failure at the four-way valve 12 and a three-way-valve switching failure detection process for detecting switching failure at the first three-way valve 16*a* and the second three-way valve 16*b*.

(Four-Way-Valve Switching Failure Detection Process)

Figure 14:
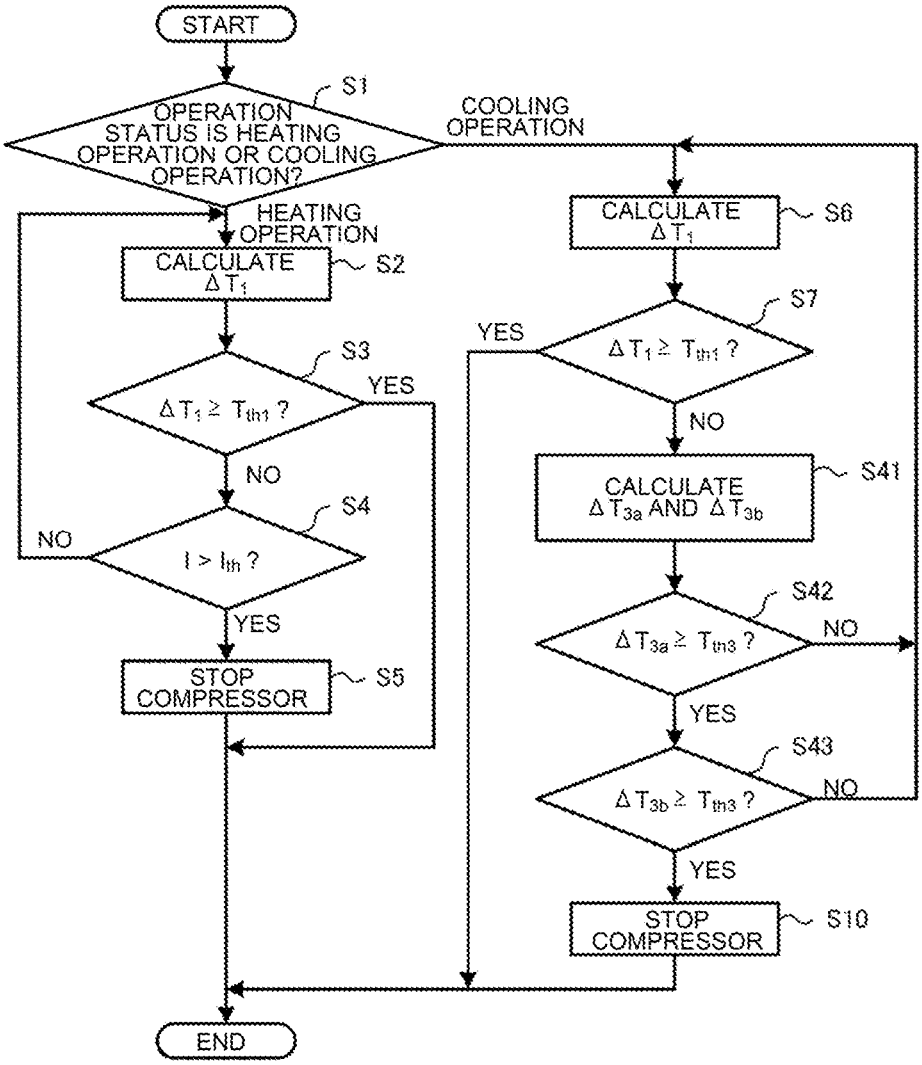
FIG. 14 is a flowchart illustrating an exemplary four-way-valve switching failure detection process by the air-conditioning apparatus according to Embodiment 2.

FIG. 14 is a flowchart illustrating an exemplary four-way-valve switching failure detection process by the air-conditioning apparatus according to Embodiment 2. In the following description, operations that are common to the four-way-valve switching failure detection process of FIG. 10 in Embodiment 1 are designated by the same reference signs, and detailed description thereof may be omitted.

In step S1, the operation status determining unit 52 of the outdoor controller 250 determines an operation status of the air-conditioning apparatus 200. In this example, the operation status determining unit 52 determines whether the operation status is the heating operation or the cooling operation. The determination operation is not limited to this example. The operation status determining unit 52 may determine which of the operations including the defrosting operation or the heating-defrosting simultaneous operation is the operation status of the air-conditioning apparatus 200.

If it is determined that the operation status of the air-conditioning apparatus 200 is the heating operation (step S1: heating operation), the process proceeds to step S2. The operations in steps S2 to S5 for the heating operation in the valve switching failure detection process are the same as those in Embodiment 1, and description thereof is omitted.

If it is determined in step S1 that the operation status of the air-conditioning apparatus 200 is the cooling operation (step S1: cooling operation), the process proceeds to step S6. In step S6, the information obtaining unit 151 obtains the indoor temperature determined by the indoor temperature sensor 33 and the indoor pipe temperature determined by the indoor pipe temperature sensor 32. The temperature difference calculating unit 153 calculates the temperature difference $\Delta T_1$ between the obtained indoor temperature and indoor pipe temperature.

In step S7, the comparison unit 154 compares the temperature difference $\Delta T_1$ calculated by the temperature difference calculating unit 153 with the first temperature difference threshold $T_{th1}$ stored in the storage unit 155. As a result of comparison, if the temperature difference $\Delta T_1$ is greater than or equal to the first temperature difference threshold $T_{th1}$ (Yes in step S7), the outdoor controller 250 determines that the four-way valve 12 operates normally in the cooling operation. The process including such a series of operations is terminated.

If the temperature difference $\Delta T_1$ is less than the first temperature difference threshold $T_{th1}$ (No in step S7), the process proceeds to step S41. In step S41, the information obtaining unit 151 obtains the discharge temperature measured by the discharge temperature sensor 31, the first surface temperature measured by the first outdoor pipe temperature sensor 35*a*, and the second surface temperature measured by the second outdoor pipe temperature sensor 35*b*. The temperature difference calculating unit 153 calculates the temperature difference $\Delta T_{3a}$ between the obtained discharge temperature and first surface temperature. Furthermore, the temperature difference calculating unit 153 calculates the temperature difference $\Delta T_{3b}$ between the obtained discharge temperature and second surface temperature.

In step S42, the comparison unit 154 compares the temperature difference $\Delta T_{3a}$ calculated by the temperature difference calculating unit 153 with the third temperature difference threshold $T_{th3}$ stored in the storage unit 155. As a result of comparison, if the temperature difference $\Delta T_{3a}$ is greater than or equal to the third temperature difference threshold $T_{th3}$ (Yes in step S42), the process proceeds to step S43. If the temperature difference $\Delta T_{3a}$ is less than the third temperature difference threshold $T_{th3}$ (No in step S42), the process returns to step S6.

In step S43, the comparison unit 154 compares the temperature difference $\Delta T_{3b}$ calculated by the temperature difference calculating unit 153 with the third temperature difference threshold $T_{th3}$ stored in the storage unit 155. As a result of comparison, if the temperature difference $\Delta T_{3b}$ is greater than or equal to the third temperature difference threshold $T_{th3}$ (Yes in step S43), the outdoor controller 250 determines that the four-way valve 12 operates abnormally in the cooling operation and accordingly determines that the temperature of the motor in the compressor 11 is likely to reach an abnormally high temperature because the refrigerant does not return to the compressor 11. In step S10, the outdoor controller 250 stops the compressor 11. If the temperature difference $\Delta T_{3b}$ is less than the third temperature difference threshold $T_{th3}$ (No in step S43), the process returns to step S6.

As described above, in the four-way-valve switching failure detection process, during the heating operation, when the temperature difference $\Delta T_1$ between the indoor temperature and the indoor pipe temperature is less than the first temperature difference threshold $T_{th1}$ and the current value I to the compressor 11 is greater than the current threshold $I_{th}$, switching failure at the four-way valve 12 is detected.

As in the example illustrated in FIG. 8, switching failure at the four-way valve 12 upon switching to the heating operation of the air-conditioning apparatus 200 causes the refrigerant discharged from the compressor 11 to be retained at the first three-way valve 16*a* and the second three-way valve 16*b*. Under such conditions, the refrigerant does not flow into and out of the indoor heat exchanger 13, so that the indoor pipe temperature is not increased by the refrigerant flowing through the indoor heat exchanger 13 and approximates the indoor temperature. In other words, the temperature difference $\Delta T_1$ between the indoor temperature and the indoor pipe temperature is small.

Since the refrigerant discharged from the compressor 11 is retained at the first three-way valve 16*a* and the second three-way valve 16*b*, the passage at the discharge portion of the compressor 11 experiences high-pressure conditions. Consequently, the discharge pressure of the compressor 11 is subjected to high-pressure conditions. At this time, since the compressor 11 discharges the refrigerant at the discharge portion under high-pressure conditions, the current value I increases abnormally.

Therefore, in Embodiment 2, when the operation status of the air-conditioning apparatus 200 is the heating operation, when the temperature difference $\Delta T_1$ is small (the temperature difference $\Delta T_1$ is less than the first temperature difference threshold $T_{th1}$), and the current value I is abnormally high (the current value I is greater than the current threshold $I_{th}$), the occurrence of switching failure at the four-way valve 12 can be determined.

In the four-way-valve switching failure detection process, during the cooling operation, when the temperature difference $\Delta T_1$ between the indoor temperature and the indoor pipe temperature is less than the first temperature difference threshold $T_{th1}$, when the temperature difference $\Delta T_{3a}$ between the discharge temperature of the compressor 11 and the first surface temperature is greater than or equal to the third temperature difference threshold $T_{th3}$, and the temperature difference $\Delta T_{3b}$ between the discharge temperature and the second surface temperature is greater than or equal to the third temperature difference threshold $T_{th3}$, switching failure at the four-way valve 12 is detected.

As in the example illustrated in FIG. 9, switching failure at the four-way valve 12 upon switching to the cooling operation of the air-conditioning apparatus 200 causes the refrigerant discharged from the compressor 11 to be retained in the indoor heat exchanger 13, the first outdoor heat exchanger 15*a*, and the second outdoor heat exchanger 15*b*. Consequently, the refrigerant does not return to the compressor 11. Under such conditions, the refrigerant does not flow through the indoor heat exchanger 13, so that the indoor pipe temperature approximates the indoor temperature. In other words, the temperature difference $\Delta T_1$ between the indoor temperature and the indoor pipe temperature is small.

Since the refrigerant does not flow through the first outdoor heat exchanger 15*a* and the second outdoor heat exchanger 15*b*, the first surface temperature and the second surface temperature do not rise. Since the refrigerant does not return to the compressor 11, the temperature of the motor in the compressor 11 increases because the motor in the compressor cannot be cooled with the refrigerant. The discharge temperature of the compressor 11 rises to a high temperature with increasing motor temperature. In other words, the temperature difference $\Delta T_3$a between the discharge temperature of the compressor 11 and the first surface temperature and the temperature difference $\Delta T_{3b}$ between the discharge temperature of the compressor 11 and the second surface temperature are greater than those in normal switching of the first three-way valve 16*a* and the second three-way valve 16*b*.

Therefore, in Embodiment 2, when the operation status of the air-conditioning apparatus 200 is the cooling operation, when the temperature difference $\Delta T_1$ is small (the temperature difference $\Delta T_1$ is less than the first temperature difference threshold $T_{th1}$), and the temperature differences $\Delta T_{3a}$ and $\Delta T_{3b}$ are large (the temperature differences $\Delta T_{3a}$ and $\Delta T_{3b}$ are greater than or equal to the third temperature difference threshold $T_{th3}$), the occurrence of switching failure at the four-way valve 12 can be determined.

(Three-Way-Valve Switching Failure Detection Process)

Figure 15:
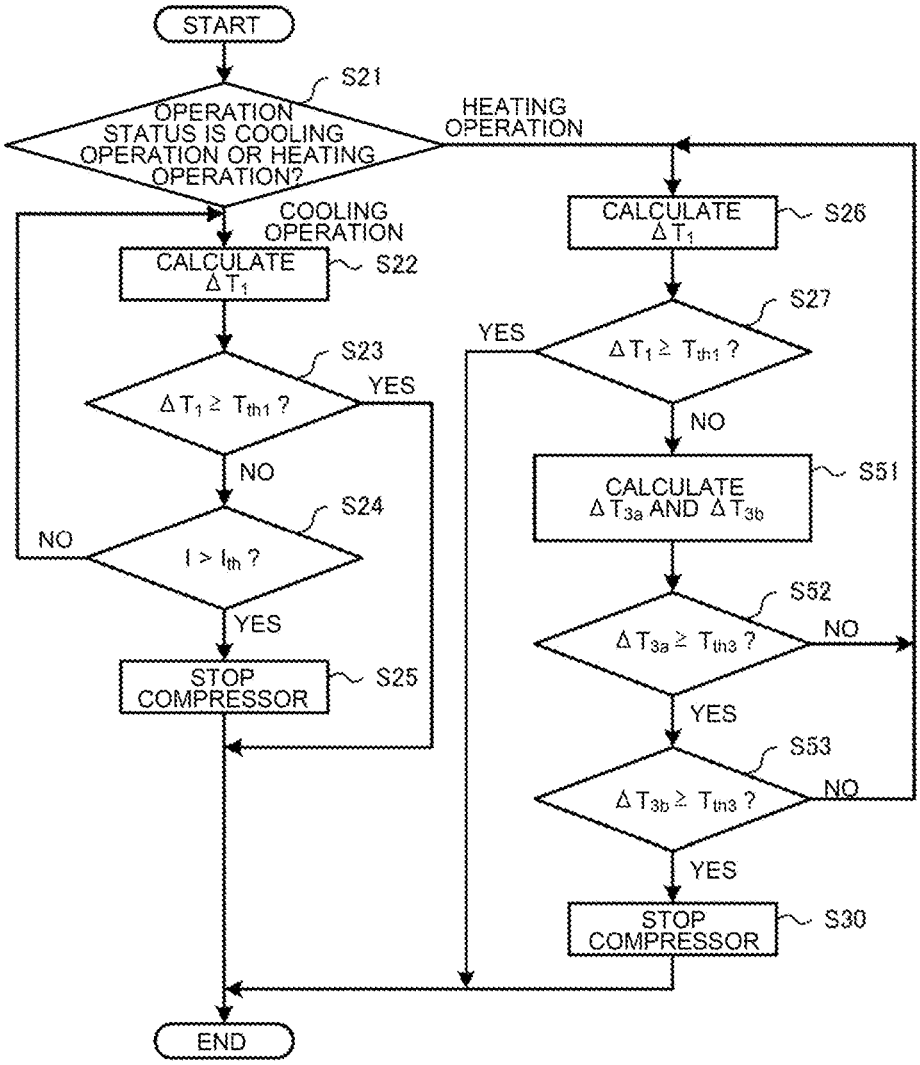
FIG. 15 is a flowchart illustrating an exemplary three-way-valve switching failure detection process by the air-conditioning apparatus according to Embodiment 2.

FIG. 15 is a flowchart illustrating an exemplary three-way-valve switching failure detection process by the air-conditioning apparatus according to Embodiment 2. In the following description, operations that are common to the three-way-valve switching failure detection process of FIG. 11 in Embodiment 1 are designated by the same reference signs, and detailed description thereof may be omitted.

In step S21, the operation status determining unit 52 determines an operation status of the air-conditioning apparatus 200. In this example, the operation status determining unit 52 determines whether the operation status is the cooling operation or the heating operation. The determination operation is not limited to this example. The operation status determining unit 52 may determine which of the operations including the defrosting operation or the heating-defrosting simultaneous operation is the operation status of the air-conditioning apparatus 200.

If it is determined that the operation status of the air-conditioning apparatus 200 is the cooling operation (step S21: cooling operation), the process proceeds to step S22. The operations in steps S22 to S25 for the cooling operation in the three-way-valve switching failure detection process are the same as those in Embodiment 1, and description thereof is omitted.

If it is determined in step S21 that the operation status of the air-conditioning apparatus 200 is the heating operation (step S21: heating operation), the process proceeds to step S26. In step S26, the information obtaining unit 151 obtains the indoor temperature measured by the indoor temperature sensor 33 and the indoor pipe temperature measured by the indoor pipe temperature sensor 32. The temperature difference calculating unit 153 calculates the temperature difference $\Delta T_1$ between the obtained indoor temperature and indoor pipe temperature.

In step S27, the comparison unit 154 compares the temperature difference $\Delta T_1$ calculated by the temperature difference calculating unit 153 with the first temperature difference threshold $T_{th1}$ stored in the storage unit 155. As a result of comparison, if the temperature difference $\Delta T_1$ is greater than or equal to the first temperature difference threshold $T_{th1}$ (Yes in step S27), the outdoor controller 250 determines that the first three-way valve 16*a* and the second three-way valve 16*b* operate normally in the heating operation. The process including such a series of operations is terminated.

If the temperature difference $\Delta T_1$ is less than the first temperature difference threshold $T_{th1}$ (No in step S27), the process proceeds to step S51. In step S51, the information obtaining unit 151 obtains the discharge temperature measured by the discharge temperature sensor 31, the first surface temperature measured by the first outdoor pipe temperature sensor 35*a*, and the second surface temperature measured by the second outdoor pipe temperature sensor 35*b*. The temperature difference calculating unit 153 calculates the temperature difference $\Delta T_{3a}$ between the obtained discharge temperature and first surface temperature. Furthermore, the temperature difference calculating unit 153 calculates the temperature difference $\Delta T_{3b}$ between the obtained discharge temperature and second surface temperature.

In step S52, the comparison unit 154 compares the temperature difference $\Delta T_{3a}$ calculated by the temperature difference calculating unit 153 with the third temperature difference threshold $T_{th3}$ stored in the storage unit 155. As a result of comparison, if the temperature difference $\Delta T_{3a}$ is greater than or equal to the third temperature difference threshold $T_{th3}$ (Yes in step S52), the process proceeds to step S53. If the temperature difference $\Delta T_{3a}$ is less than the third temperature difference threshold $T_{th3}$ (No in step S52), the process returns to step S26.

In step S53, the comparison unit 154 compares the temperature difference $\Delta T_{3b}$ calculated by the temperature difference calculating unit 153 with the third temperature difference threshold $T_{th3}$ stored in the storage unit 155. As a result of comparison, if the temperature difference $\Delta T_{3b}$ is greater than or equal to the third temperature difference threshold $T_{th3}$ (Yes in step S53), the outdoor controller 250 determines that at least the first three-way valve 16*a* or the second three-way valve 16*b* operates abnormally in the heating operation and accordingly determines that the temperature of the motor in the compressor 11 is likely to reach an abnormally high temperature because the refrigerant does not return to the compressor 11. In step S30, the outdoor controller 250 stops the compressor 11. If the temperature difference $\Delta T_{3b}$ is less than the third temperature difference threshold $T_{th3}$ (No in step S53), the process returns to step S26.

As described above, in the three-way-valve switching failure detection process, during the cooling operation, when the temperature difference $\Delta T_1$ between the indoor temperature and the indoor pipe temperature is less than the first temperature difference threshold $T_{th1}$ and the current value I to the compressor 11 is greater than the current threshold $I_{th}$, switching failure at least the first three-way valve 16*a* or the second three-way valve 16*b* is detected.

As in the example illustrated in FIG. 8, switching failure at at least the first three-way valve 16*a* or the second three-way valve 16*b* upon switching to the cooling operation of the air-conditioning apparatus 200 causes the refrigerant discharged from the compressor 11 to be retained at the first three-way valve 16*a* and the second three-way valve 16*b*. Under such conditions, the refrigerant does not flow into and out of the indoor heat exchanger 13, so that the indoor pipe temperature is not increased by the refrigerant flowing through the indoor heat exchanger 13 and approximates the indoor temperature. In other words, the temperature difference $\Delta T_1$ between the indoor temperature and the indoor pipe temperature is small.

Since the refrigerant discharged from the compressor 11 is retained at the first three-way valve 16*a* and the second three-way valve 16*b*, the passage at the discharge portion of the compressor 11 experiences high-pressure conditions. Consequently, the discharge pressure of the compressor 11 is subjected to high-pressure conditions. At this time, since the compressor 11 discharges the refrigerant at the discharge portion under high-pressure conditions, the current value I increases abnormally.

Therefore, in Embodiment 2, when the operation status of the air-conditioning apparatus 200 is the cooling operation, when the temperature difference $\Delta T_1$ is small (the temperature difference $\Delta T_1$ is less than the first temperature difference threshold $T_{th1}$), and the current value I is abnormally high (the current value I is greater than the current threshold $I_{th}$), the occurrence of switching failure at at least the first three-way valve 16*a* or the second three-way valve 16*b* can be determined.

In the three-way-valve switching failure detection process, during the heating operation, when the temperature difference $\Delta T_1$ between the indoor temperature and the indoor pipe temperature is less than the first temperature difference threshold $T_{th1}$, when the temperature difference $\Delta T_{3a}$ between the discharge temperature of the compressor 11 and the first surface temperature is greater than or equal to the third temperature difference threshold $T_{th3}$, and the temperature difference $\Delta T_{3b}$ between the discharge temperature and the second surface temperature is greater than or equal to the third temperature difference threshold $T_{th3}$, switching failure at at least the first three-way valve 16*a* or the second three-way valve 16*b* is detected.

As in the example illustrated in FIG. 9, switching failure at at least the first three-way valve 16*a* or the second three-way valve 16*b* upon switching to the heating operation of the air-conditioning apparatus 200 causes the refrigerant discharged from the compressor 11 to be retained in the indoor heat exchanger 13, the first outdoor heat exchanger 15*a*, and the second outdoor heat exchanger 15*b*. Consequently, the refrigerant does not return to the compressor 11. Under such conditions, the refrigerant does not flow through the indoor heat exchanger 13, so that the indoor pipe temperature approximates the indoor temperature. In other words, the temperature difference $\Delta T_1$ between the indoor temperature and the indoor pipe temperature is small.

Since the refrigerant does not flow through the first outdoor heat exchanger 15*a* and the second outdoor heat exchanger 15*b*, the first surface temperature and the second surface temperature do not rise. The refrigerant does not return to the compressor 11, so that the temperature of the motor in the compressor 11 increases because the motor in the compressor cannot be cooled with the refrigerant. The discharge temperature of the compressor 11 rises to a high temperature with increasing motor temperature. In other words, the temperature difference $\Delta T_3$a between the discharge temperature of the compressor 11 and the first surface temperature and the temperature difference $\Delta T_{3b}$ between the discharge temperature of the compressor 11 and the second surface temperature are greater than those in normal switching of the first three-way valve 16*a* and the second three-way valve 16*b*.

Therefore, in Embodiment 2, when the operation status of the air-conditioning apparatus 200 is the heating operation, when the temperature difference $\Delta T_1$ is small (the temperature difference $\Delta T_1$ is less than the first temperature difference threshold $T_{th1}$), and the temperature differences $\Delta T_{3a}$ and $\Delta T_{3b}$ are large (the temperature differences $\Delta T_{3a}$ and $\Delta T_{3b}$ are greater than or equal to the third temperature difference threshold $T_{th3}$), the occurrence of switching failure at at least the first three-way valve 16*a* or the second three-way valve 16*b* can be determined.

As described above, in the air-conditioning apparatus 200 according to Embodiment 2, the outdoor controller 250 causes the discharge temperature sensor 31, the indoor pipe temperature sensor 32, the indoor temperature sensor 33, the first outdoor pipe temperature sensor 35*a*, and the second outdoor pipe temperature sensor 35*b* to measure temperatures at some portions in the refrigerant circuit 10, and causes the current sensor 34 to measure a current to the compressor 11. The outdoor controller 250 detects switching failure at the four-way valve 12 or at least the first three-way valve 16*a* or the second three-way valve 16*b* on the basis of the measurements and the operation status.

As described above, like the air-conditioning apparatus 100 according to Embodiment 1, the air-conditioning apparatus 200 according to Embodiment 2 can determine whether switching failure has occurred at any of the valves by using, for example, temperatures measured at some portions in the refrigerant circuit 10.

In Embodiment 2, during the heating operation, when the temperature difference $\Delta T_1$ between the indoor temperature and the indoor pipe temperature is less than the first temperature difference threshold $T_{th1}$ and the current value I is greater than the current threshold $I_{th}$, the outdoor controller 250 determines that switching failure has occurred at the four-way valve 12. As described above, the outdoor controller 250 can detect switching failure at the four-way valve 12 by determining the operation status, the indoor pipe temperature in the indoor heat exchanger 13, and the current value I to the compressor 11.

In Embodiment 2, during the cooling operation, when the temperature difference $\Delta T_1$ between the indoor temperature and the indoor pipe temperature is less than the first temperature difference threshold $T_{th1}$, when the temperature difference $\Delta T_{3a}$ between the discharge temperature and the first surface temperature is greater than or equal to the third temperature difference threshold $T_{th3}$, and the temperature difference $\Delta T_{3b}$ between the discharge temperature and the second surface temperature is greater than or equal to the third temperature difference threshold $T_{th3}$, the outdoor controller 250 determines that switching failure has occurred at the four-way valve 12. As described above, the outdoor controller 250 can detect switching failure at the four-way valve 12 by determining the operation status, the indoor pipe temperature in the indoor heat exchanger 13, the first surface temperature, and the second surface temperature.

In Embodiment 2, during the cooling operation, when the temperature difference $\Delta T_1$ between the indoor temperature and the indoor pipe temperature is less than the first temperature difference threshold $T_{th1}$ and the current value I is greater than the current threshold $I_{th}$, the outdoor controller 250 determines that switching failure has occurred at the first three-way valve 16*a* or the second three-way valve 16*b*. As described above, the outdoor controller 250 can detect switching failure at the first three-way valve 16*a* or the second three-way valve 16*b* by determining the operation status, the indoor pipe temperature in the indoor heat exchanger 13, and the current value I to the compressor 11.

In Embodiment 2, during the heating operation, when the temperature difference $\Delta T_1$ between the indoor temperature and the indoor pipe temperature is less than the first temperature difference threshold $T_{th1}$, when the temperature difference $\Delta T_{3a}$ between the discharge temperature and the first surface temperature is greater than or equal to the third temperature difference threshold $T_{th3}$, and the temperature difference $\Delta T_{3b}$ between the discharge temperature and the second surface temperature is greater than or equal to the third temperature difference threshold $T_{th3}$, the outdoor controller 250 determines that switching failure has occurred at the first three-way valve 16*a* or the second three-way valve 16*b*. As described above, the outdoor controller 250 can detect switching failure at the first three-way valve 16*a* or the second three-way valve 16*b* by determining the operation status, the indoor pipe temperature in the indoor heat exchanger 13, the first surface temperature, and the second surface temperature.

In Embodiment 2, when detecting switching failure at the four-way valve 12, the first three-way valve 16*a*, or the second three-way valve 16*b*, the outdoor controller 250 stops the compressor 11. This can reduce the risk of a breakdown of the compressor 11 caused by continuous operation of the air-conditioning apparatus 200 as in Embodiment 1.

The invention claimed is:

1. An air-conditioning apparatus comprising:

a four-way valve having a first port, a second port, a third port, and a fourth port;

a first three-way valve and a second three-way valve each having a fifth port, a sixth port, a seventh port, and an eighth port, the eighth port being closed;

a compressor having a discharge portion connected to the first port and a suction portion connected to the second port and the sixth ports of the first and second three-way valves, the compressor being configured to suck refrigerant, compress the refrigerant, and discharge the compressed refrigerant;

an indoor heat exchanger connected to the fourth port and configured to exchange heat between the refrigerant and indoor air;

an expansion valve connected to the indoor heat exchanger and configured to reduce a pressure of the refrigerant;

a first outdoor heat exchanger disposed between the expansion valve and the seventh port of the first three-way valve, the first outdoor heat exchanger being configured to exchange heat between the refrigerant and outdoor air;

a second outdoor heat exchanger disposed between the expansion valve and the seventh port of the second three-way valve, the second outdoor heat exchanger being configured to exchange heat between the refrigerant and the outdoor air;

a bypass expansion valve disposed between the discharge portion of the compressor and the fifth ports of the first and second three-way valves;

a check valve having a first end connected to the third port and a second end connected between the bypass expansion valve and the fifth ports of the first and second three-way valves, the check valve being configured to allow the refrigerant to flow in a direction from the first end to the second end and block the refrigerant from flowing in an opposite direction therefrom;

a discharge temperature sensor configured to measure a discharge temperature of the refrigerant discharged from the compressor;

an indoor pipe temperature sensor configured to measure a pipe temperature of a pipe through which the refrigerant flows in the indoor heat exchanger;

an indoor temperature sensor configured to measure an indoor temperature being a temperature of the indoor air;

a current sensor configured to measure a current value of a current supplied to the compressor; and a controller configured to detect a switching failure at the four-way valve, the first three-way valve, and the second three-way valve, the air-conditioning apparatus being capable of performing a heating operation in which the first and second outdoor heat exchangers operate as evaporators and the indoor heat exchanger operates as a condenser, a defrosting operation and a cooling operation in each of which the first and second outdoor heat exchangers operate as condensers, and a heating-defrosting simultaneous operation in which one of the first and second outdoor heat exchangers operates as an evaporator and an other one of the first and second outdoor heat exchangers and the indoor heat exchanger operate as condensers, wherein the controller is configured to detect the switching failure at the four-way valve, the first three-way valve, or the second three-way valve by using the temperatures measured by the discharge temperature sensor, the indoor pipe temperature sensor, and the indoor temperature sensor and the current value measured by the current sensor in consideration of an operation status.

2. The air-conditioning apparatus of claim 1, wherein during the heating operation, when a temperature difference between the indoor temperature and the pipe temperature is less than a first temperature difference threshold and the current value is greater than a current threshold, the controller is configured to determine that the switching failure at the four-way valve is occurring.

3. The air-conditioning apparatus of claim 1, wherein during the cooling operation, when a temperature difference between the indoor temperature and the pipe temperature is less than a first temperature difference threshold and the current value is greater than a current threshold, the controller is configured to determine that the switching failure at the first three-way valve or the second three-way valve is occurring.

4. The air-conditioning apparatus of claim 1, wherein during the cooling operation, when a temperature difference between the indoor temperature and the pipe temperature is less than a first temperature difference threshold and a temperature difference between the discharge temperature and the pipe temperature is greater than or equal to a second temperature difference threshold, the controller is configured to determine that the switching failure at the four-way valve is occurring.

5. The air-conditioning apparatus of claim 1, wherein during the heating operation, when a temperature difference between the indoor temperature and the pipe temperature is less than a first temperature difference threshold and a temperature difference between the discharge temperature and the pipe temperature is greater than or equal to a second temperature difference threshold, the controller is configured to determine that the switching failure at the first three-way valve or the second three-way valve is occurring.

6. The air-conditioning apparatus of claim 1, further comprising:

a first outdoor pipe temperature sensor disposed at a pipe connecting the first outdoor heat exchanger to the seventh port of the first three-way valve, the first outdoor pipe temperature sensor being configured to measure a first surface temperature of the pipe; and a second outdoor pipe temperature sensor disposed at a pipe connecting the second outdoor heat exchanger to the seventh port of the second three-way valve, the second outdoor pipe temperature sensor being configured to measure a second surface temperature of the pipe, wherein the controller is configured to detect the switching failure at the four-way valve, the first three-way valve, or the second three-way valve by using the temperatures measured by the discharge temperature sensor, the indoor pipe temperature sensor, the indoor temperature sensor, the first outdoor pipe temperature sensor, and the second outdoor pipe temperature sensor and the current value measured by the current sensor in consideration of the operation status.

7. The air-conditioning apparatus of claim 6, wherein during the cooling operation, when a temperature difference between the indoor temperature and the pipe temperature is less than a first temperature difference threshold, a temperature difference between the discharge temperature and the first surface temperature is greater than or equal to a third temperature difference threshold, and a temperature difference between the discharge temperature and the second surface temperature is greater than or equal to the third temperature difference threshold, the controller is configured to determine that the switching failure at the four-way valve is occurring.

8. The air-conditioning apparatus of claim 6, wherein during the heating operation, when a temperature difference between the indoor temperature and the pipe temperature is less than a first temperature difference threshold, when a temperature difference between the discharge temperature and the first surface temperature is greater than or equal to a third temperature difference threshold, and a temperature difference between the discharge temperature and the second surface temperature is greater than or equal to the third temperature difference threshold, the controller is configured to determine that the switching failure at the first three-way valve or the second three-way valve is occurring.

9. The air-conditioning apparatus of claim 1, wherein the controller is configured to stop the compressor in response to detecting the switching failure at the four-way valve, the first three-way valve, or the second three-way valve.

* * * * *